US012320525B2

(12) United States Patent
Karlovich

(10) Patent No.: US 12,320,525 B2
(45) Date of Patent: Jun. 3, 2025

(54) STOVE PANEL PROTECTOR

(71) Applicant: Benjamin Douglas Karlovich, Saint Johns, FL (US)

(72) Inventor: Benjamin Douglas Karlovich, Saint Johns, FL (US)

( * ) Notice: Subject to any disclaimer, the term of this patent is extended or adjusted under 35 U.S.C. 154(b) by 0 days.

(21) Appl. No.: 18/626,768

(22) Filed: Apr. 4, 2024

(65) Prior Publication Data

US 2024/0337390 A1 Oct. 10, 2024

Related U.S. Application Data

(60) Provisional application No. 63/494,057, filed on Apr. 4, 2023.

(51) Int. Cl.
*F24C 15/12* (2006.01)

(52) U.S. Cl.
CPC ..... *F24C 15/12* (2013.01)

(58) Field of Classification Search
CPC ..... F24C 15/12
USPC ..... 126/1 R, 299 C
See application file for complete search history.

(56) References Cited

U.S. PATENT DOCUMENTS 5,357,942 A * 10/1994 Williams ..... F24C 7/082 126/299 C
5,546,928 A * 8/1996 Lewis ..... F24C 15/36 126/211
5,615,667 A * 4/1997 Seeley ..... F24C 15/12 126/211
6,906,275 B2 * 6/2005 Koyama ..... H01H 13/7006 200/406
6,932,595 B1 * 8/2005 Booker ..... F24C 15/36 431/153
7,401,610 B1 * 7/2008 Cherry ..... F16K 35/10 126/211
2005/0279348 A1 * 12/2005 Cheng ..... F24C 3/124 126/638
2008/0283032 A1 * 11/2008 Dang ..... F24C 15/36 126/42
2020/0271326 A1 * 8/2020 Kozinski ..... F24C 3/124

FOREIGN PATENT DOCUMENTS

CN 113051290 A * 6/2021

OTHER PUBLICATIONS

Foreign DOC translation 2019.*

* cited by examiner

*Primary Examiner* — Avinash A Savani
(74) *Attorney, Agent, or Firm* — Wilson Dutra, PLLC; Camille A. Wilson

(57) ABSTRACT

The present disclosure provides a stove panel protector. The stove panel protector may comprise a profile that matches the control panel of the stove, cutouts to match the location of control knobs on the control panel, and one or more securing mechanisms to removably secure the control panel protector to the control panel of the stove. A method for attaching the stove protector to a stove may comprise removing control knobs from the stove, removably securing the stove panel protector to the control panel of the appliance, where the stove panel protector has a profile that matches the control panel of the stove and includes cutouts that match the location of the control knobs on the control panel, and reattaching the control knobs to the stove.

17 Claims, 30 Drawing Sheets

STOVE PANEL PROTECTOR

CROSS-REFERENCE TO RELATED APPLICATION

This application claims priority to and the full benefit of U.S. Provisional Patent Application Ser. No. 63/494,057 (filed Apr. 4, 2023, and titled "STOVE PANEL PROTECTOR"), the entire contents of which are incorporated in this application by reference.

BACKGROUND

Traditionally, a kitchen stove, range, cooktop, or oven is a kitchen appliance designed for cooking food. Kitchen stoves rely on direct heat for the cooking process and may also contain an oven underneath or to the side used for baking. Traditionally, these have been fueled by wood; the earliest known example of such was the Castrol stove. More modern versions such as the popular Rayburn range offer a choice between using wood or gas.

Gas stoves were first introduced by Moravian Zachaus Winzler in 1802. Today, according to the US Energy Information Administration, 35% of American households use gas stoves. They are chosen as they offer better temperature control, durability, low cost, and speed of heating. Gas-powered stoves are criticized for environmental concerns with methane leaks and the usage of natural gas, the danger of carbon monoxide release, and difficulty in cleaning.

Induction stoves were first patented in the early 1900s. These stoves are praised for their cost effectiveness, case of cleaning, options to control low heat, and stable base for many types and sizes of pots and other cooking tools. Critics note that abrasive cleaners can damage induction stoves, that gas stoves have more traditional culinary associations, and that induction stoves are unable to operate during power outages.

Stoves are also used for heating purposes. Benjamin Franklin's invention in 1740 popularized the widespread usage of modern heating stoves and fireplaces. Today, wood stoves are commonly used for warming homes and are credited for their cost-effectiveness compared to coal and gas and their connection to the practices of human ancestors.

A pellet stove is a type of clean-burning stove that uses small, biological fuel pellets which are renewable and very clean-burning. Home heating using a pellet stove is an alternative used worldwide, with rapid growth in Europe. The pellets are made of renewable material typically wood sawdust or off-cuts. There are more than half a million homes in North America using pellet stoves for heat, and probably a similar number in Europe. The pellet stove typically uses a feed screw to transfer pellets from a storage hopper to a combustion chamber. Air is provided by an electric blower to help facilitate combustion. The ignition is automatic, using a stream of air heated by an electrical element. The rotation speed of the feeder and the fan speeds can be varied to modulate the heat output.

A gas stove system is remarkably simple and trouble-free. In fact, difficulties arise only when the flow of gas becomes hindered, which is often caused by food residue that spills over the sides of pots and pans and clogs the ports around the burner heads. If left unattended, this food residue can become quite hard and difficult to remove. The best rule of thumb is to clean gas burners whenever the flame becomes irregular or exhibits a yellow color. Barring that, cleaning the burners once a month is probably sufficient. There is some variation in how manufacturers recommend cleaning the burner heads on a gas stove. Many stove panels are made from either a black, white or stainless-steel finish that is susceptible to damage from grease, oils, spills and other damage. Often, stove manufacturers do not consider the aftermaths of usage of a stove and the difficulties in maintaining the cleanness of the stove, especially in the area around the stove panel. For example, during use stoves are often exposed to harsh conditions with grease splashes, oils, spills and harsh cleaning chemicals that become an obstacle in maintaining the condition and usage of stove. In addition, the area around the stove panel can face peeling, scratches, dents, cracks and other damage to the panel area such as temperature indicator damages. Given the fact both gas and electric stoves have the same issues for cleaning and damaging a stove panel protector is needed for both types of stoves to help protect the panel area of the stove.

SUMMARY OF THE DISCLOSURE

What is needed is a stove panel protector to protect the panel of a stove. In an example, a stove panel protector to help protect the control panel of a stove can include a profile that matches the control panel of the stove, cutouts to match the location of control knobs on the control panel of the stove, and one or more securing mechanisms to removably secure the control panel protector to the control panel of the stove. In some examples, a method of attaching a stove panel protector to a stove can include removing control knobs from the stove, removably securing the stove panel protector to the control panel of the appliance, where the stove panel protector has a profile that matches the control panel of the stove and includes cutouts that match the location of the control knobs on the control panel, and reattaching the control knobs to the stove. In other examples, a method for creating a control panel protector for an appliance can include determining a profile of a control panel for an appliance, determining the location of control knobs on the control panel, shaping a control panel protector to fit the profile of the control panel, creating cutouts in the control panel protector to match the location of the control knobs, and adding at least one attachment mechanism to allow the control panel protector to be removably securing the control panel protector to the control panel of the appliance.

A number of embodiments of the present disclosure will be described. While this specification contains many specific implementation details, these should not be construed as limitations on the scope of any disclosures or of what may be claimed, but rather as descriptions of features specific to particular embodiments of the present disclosure. It is understood to those skilled in the art that variations, modifications, and alterations may be apparent. It will be understood that various modifications may be made without departing from the spirit and scope of the disclosure.

BRIEF DESCRIPTION OF THE DRAWINGS

The accompanying drawings that are incorporated in and constitute a part of this specification illustrate several embodiments of the disclosure and, together with the description, serve to explain the principles of the disclosure.

The Figures are not necessarily drawn to scale, as their dimensions can be varied considerably without departing from the scope of the present disclosure.

DETAILED DESCRIPTION

The present disclosure provides generally for a stove panel protector. According to the present disclosure, the stove panel protector can be secured to a panel of a stove. The stove panel protector can protect the panel of the stove from physical damage as well as from spills, splashes, spatters, etc.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Stove: as used herein refers to an apparatus for cooking or heating that operates by burning fuel or using electricity.

Stove panel: as used herein refers to the area of the stove where the controls for the stove are located and/or where information related to the stove is presented.

Appliance: as used herein refers to a device or piece of equipment designed to perform a specific task.

Appliance panel: as used herein refers to the area of the appliance where the controls for the appliance are located and/or where information related to the appliance are presented. Attachment mechanism: as used herein refers to a mechanism that couples, fastens, affixes, joins, connects, secures, etc. one object to another object.

Figure 1:
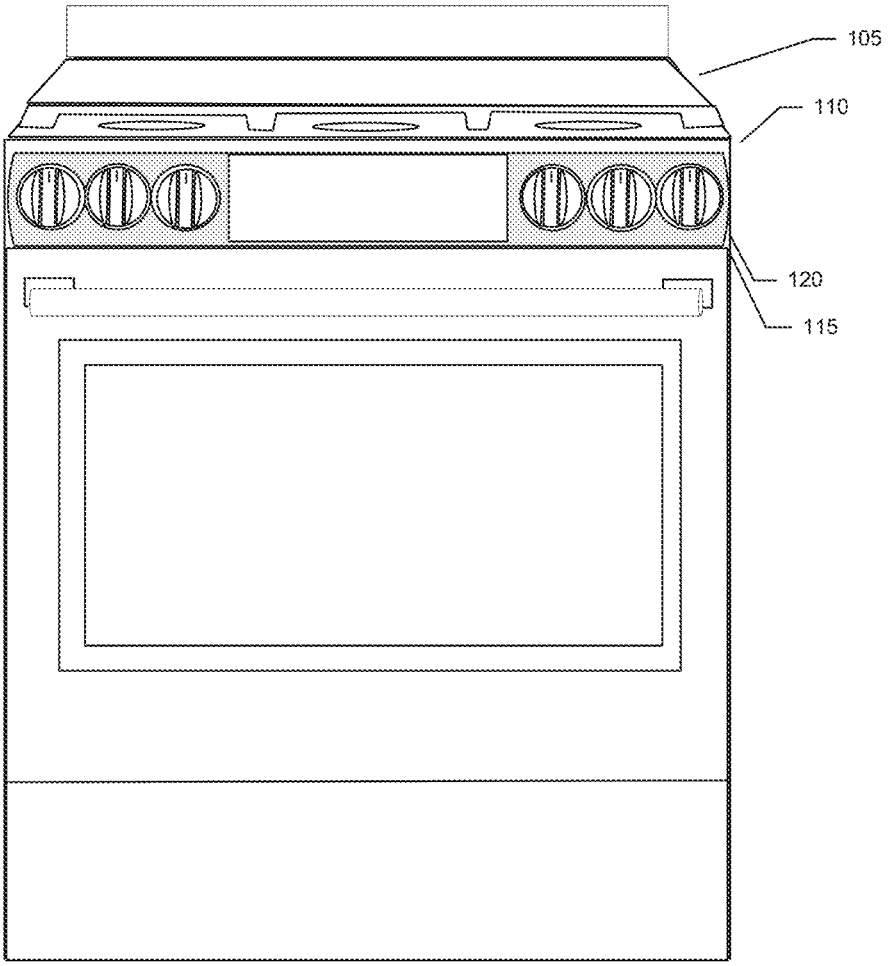
FIG. 1 illustrates a stove panel protector on a stove, according to some embodiments of the present disclosure.

Referring now to FIG. 1, a stove panel protector 120, according to some embodiments of the present disclosure, is illustrated. As illustrated in FIG. 1, the stove panel protector 120 is located on a stove panel 110 of a stove 105. The stove panel protector 120 is under burner control knobs 115 of the stove 105 and allows a user to access the burner control knobs 115 to control the burners of the stove. The stove panel protector 120 helps to protect the stove panel 110 from physical damage as well as from spills, splashes, spatters, etc.

In some examples, the stove panel protector 120 lays flat on the stove's panel surface and is a stove panel protector covering the stove panel 110 and area around the burner control knobs 115. The stove panel protector 120 can be a clear, non-clear, patterned, etc. removable, reusable, heat-resistant and fire-retardant protective cover to fit around the knob(s) and/or electric control board of various stoves to help protect the stove panel area from damages.

In some examples, the stove panel protector 120 is a protective cover made from durable, heat-resistant, and/or fire-retardant material with a border shape that fits either each individual burner control knob 115 or fits the outline of the stove 105, range, oven or cooktop panel and has one or more cutouts (circles, squares or other cutout shapes) through the top and bottom of the material to fit on top of the stove panel 115 and/or around the burner control knobs 115 and/or electric control board(s) of the stove 105, range, cooktop, or oven panel.

During use, the stove panel protector 120 attaches or lays flat on the stove panel 110 and blocks grease, oils, cleaning chemicals, and spills from damaging the stove panel 110 or decals/temperature indicators as well as prevents dents, scratches, and other damage to the stove panel 110 area. The stove panel protector 120 is placed where the stove panel 110 is located and on the front, side or back of the stove. The stove panel protector 120 fits the shape of the stove panel 110 and is placed underneath and/or around the burner control knobs 115 and/or the electric control board of the stove 105. The stove panel protector 120 lays flat on the stove panel 110. To install the stove panel protector 120 on the stove 105, the user may remove the burner control knobs 115, align and place the stove panel protector 120 on the stove panel 110, and reattach the burner control knobs 115. The stove panel protector 120 can either be fastened down to the stove panel 110, sealed on the edges, and/or freely lay on top of the stove panel 110. The stove panel protector 120 is removeable, reusable and washable.

The stove panel protector 120 protects the stove panel 110 surface area by blocking grease, oils, spills, cleaning chemicals from damaging the temperature indicators and/or panel surface. The stove panel protector 120 can be sealed around the edges or lay freely on the stove panel 110. The stove panel protector 120 also provides a protective cover for the stove panel 110 to help mitigate scratches, dents, and other damage to the stove panel 110.

The stove panel protector 120 can be comprised of polycarbonate, tempered glass or glass, acrylic, PTFE, vinyl, PEEK materials, PVC, and other heat-resistant and fire-retardant material. Because the stove panel protector 120 is made of a heat resistant and/or fire-retardant material, the stove panel protector 120 is able to handle hot grease splashes and other intense heat without easily deforming.

The stove panel protector 120 helps prolong the life of a stove by protecting the stove panel 110 and any temperature indicators against damage. The stove panel protector 120 is reusable, removable and washable allowing users to remove the stove panel protector 120 and wash the stove panel protector 120, with the stove panel 110 area remaining untouched and clean. In some examples, the stove panel protector 120 is dishwasher safe. This makes cleaning the stove panel 110 area much easier and simpler as compared to having to wipe and spray and scrub around difficult to reach areas of the stove panel 110 and burner control knobs 115 without the stove panel protector 120. As stoves, ranges, cooktops and ovens age, the temperature indicators are susceptible to wear and tear. The stove panel protector 120 helps prolong the life of indicators, panel, and the stove panel 110 area.

The shape of the stove panel protector 120 is determined by the stove's model number. The shape of the stove panel protector 120 has one or more cutouts (circular, square, or other shape) that allows the stove panel protector 120 to fit around the burner control knobs 115 and/or electric control board and protects the burner control knobs 115 and decal temperature indicators.

Figure 2A:
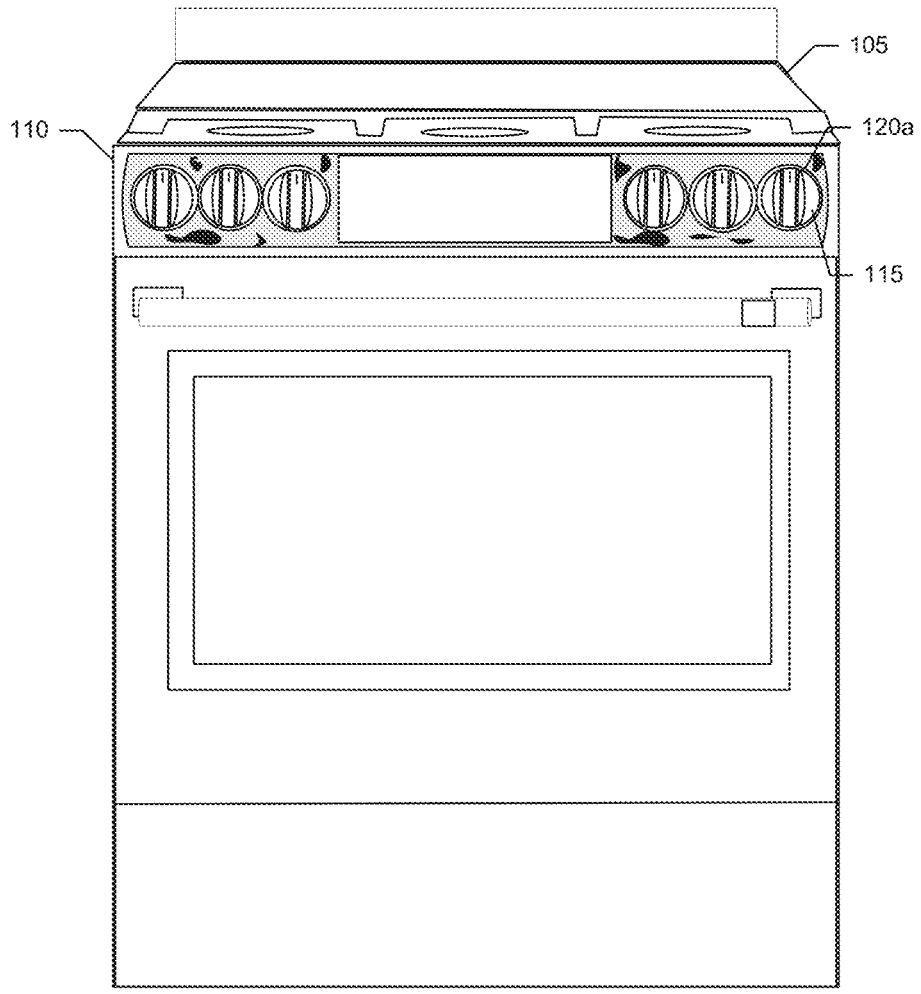
FIG. 2A illustrates a dirty stove panel protector on a stove, according to some embodiments of the present disclosure.

Referring now to FIGS. 2A-2D, a stove panel protector 220, according to some embodiments of the present disclosure, is illustrated. As illustrated in FIG. 2A, a dirty stove panel protector 220*a* is on the stove 105. The stove 105 includes the stove panel 110 and the burner control knobs 115.

Figure 2B:
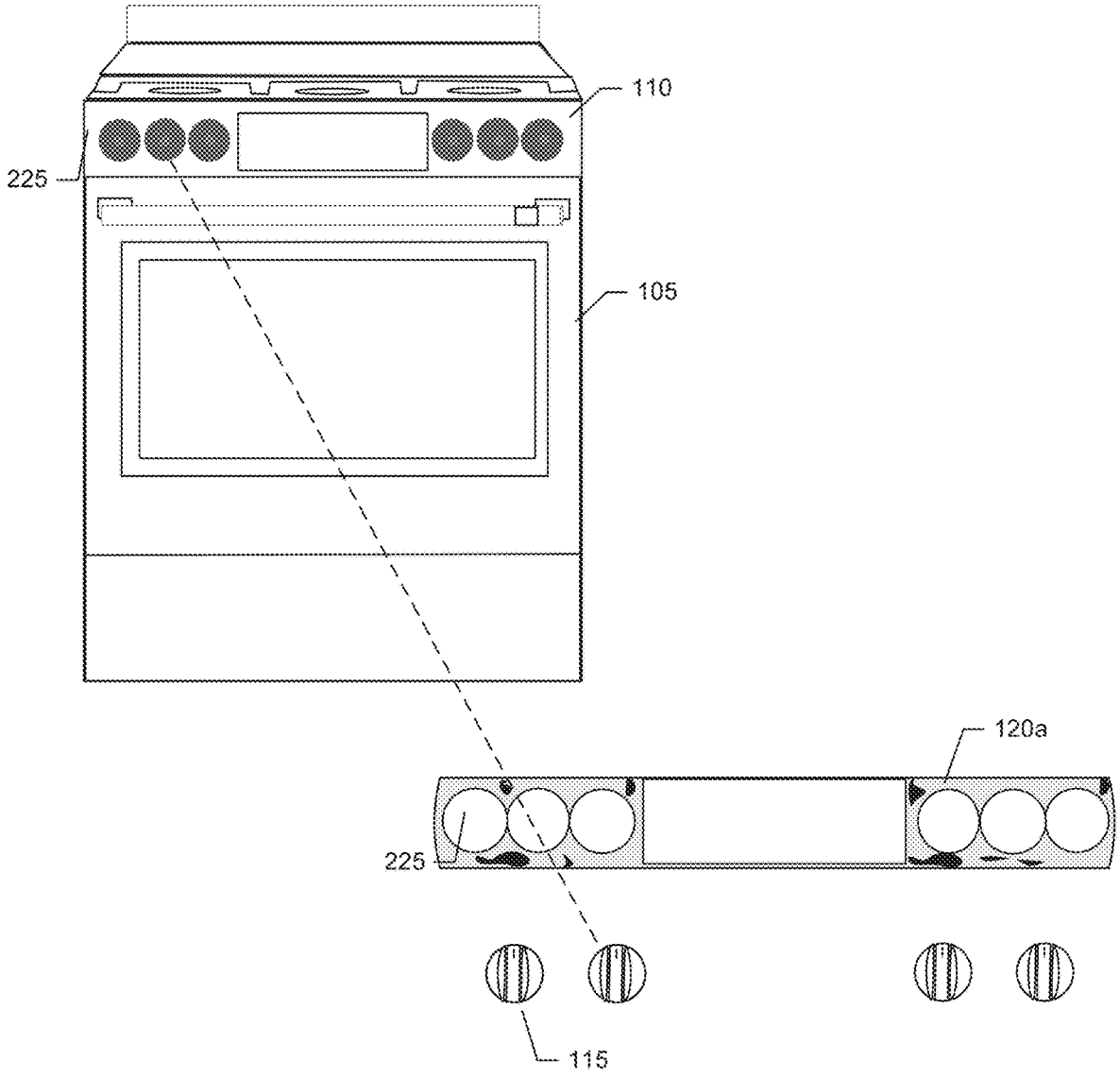
FIG. 2B illustrates the dirty stove panel protector removed from the stove, according to some embodiments of the present disclosure.

As illustrated in FIG. 2B, the control knobs 115 and the dirty stove panel protector 220*a* can be removed from the stove panel 110. When the control knobs 115 are removed from the stove panel 110, control knob receptacles 225 are exposed. The stove panel protector 220 has control knob cutouts 230 that align with the control knob receptacles 225 on the stove panel 110.

Figure 2C:
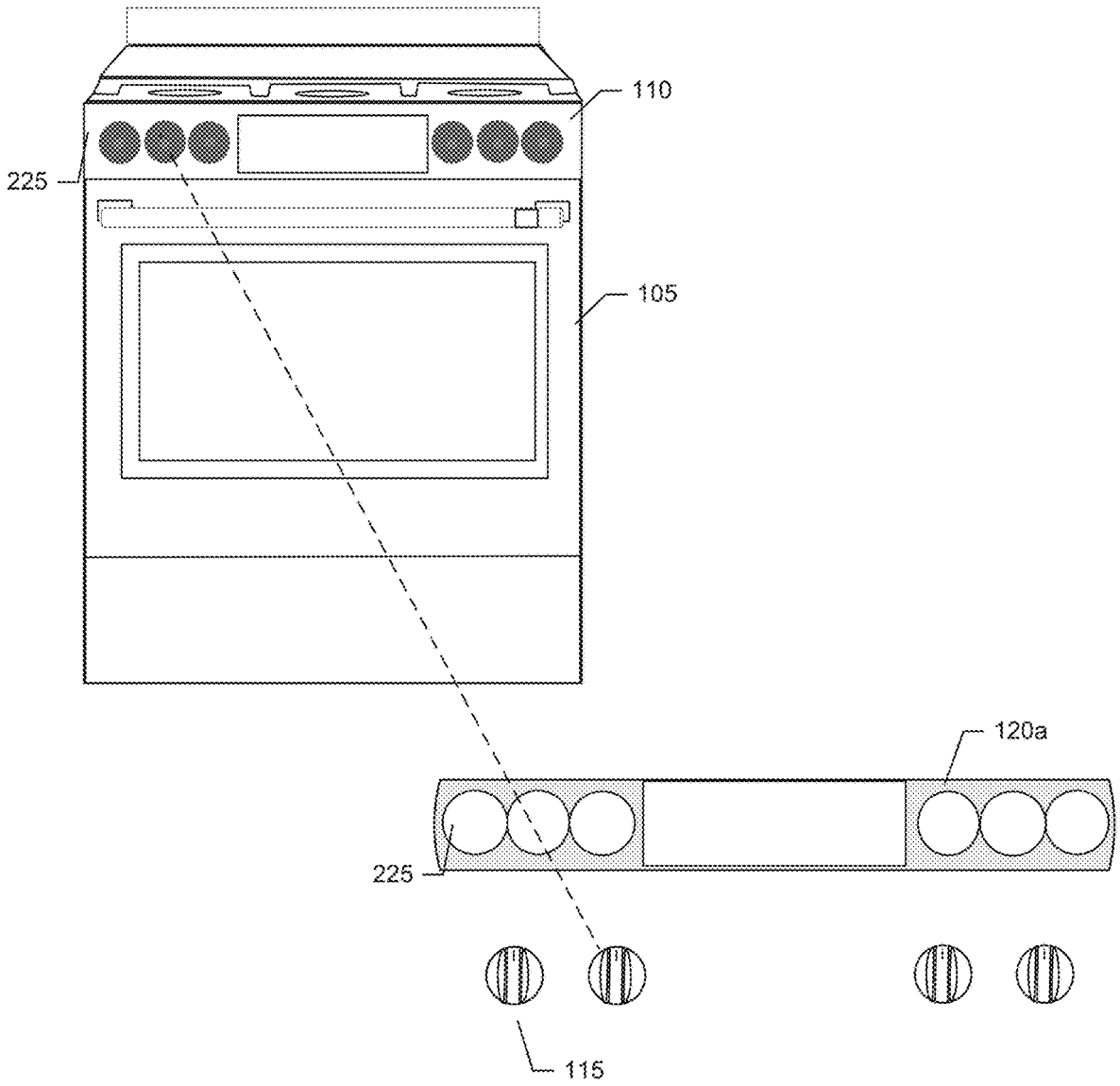
FIG. 2C illustrates the dirty stove panel protector cleaned and removed from the stove, according to some embodiments of the present disclosure.
Figure 2D:
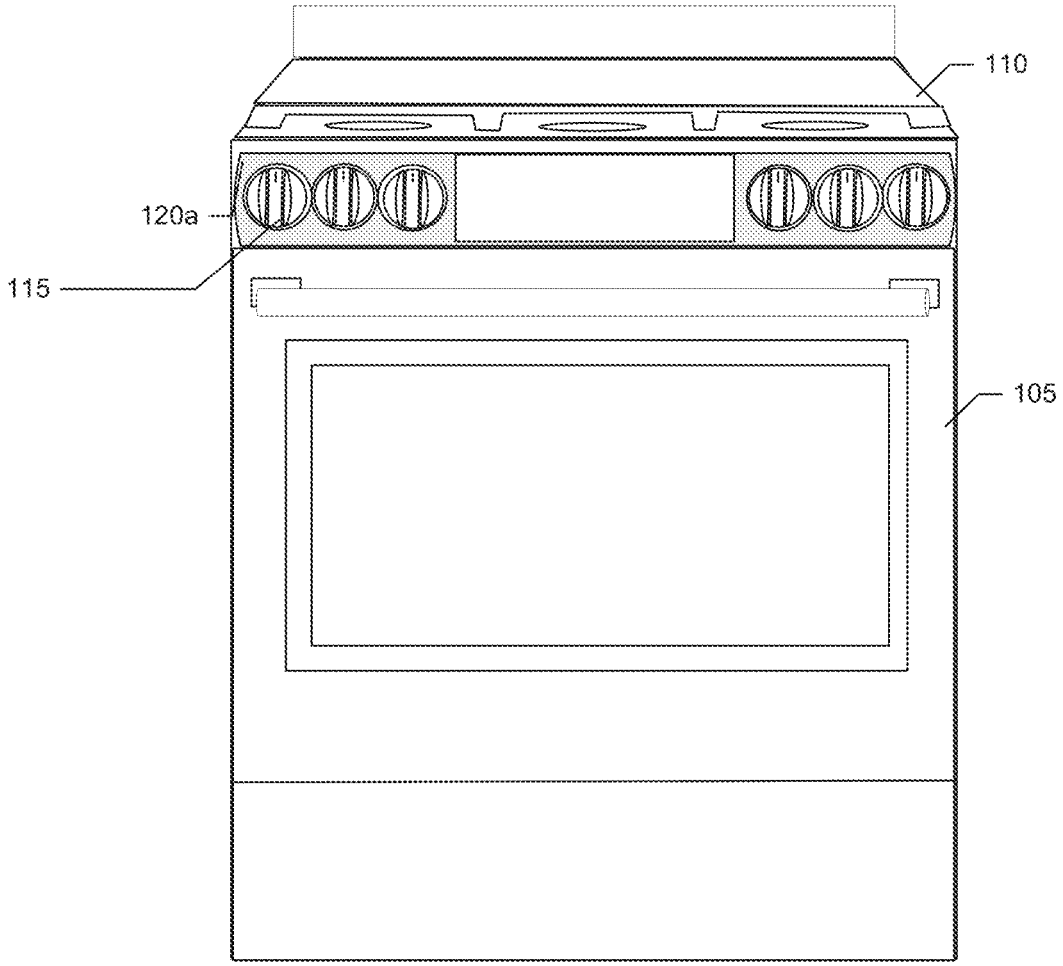
FIG. 2D illustrates the clean stove panel protector on the stove, according to some embodiments of the present disclosure.

As illustrated in FIG. 2C, the dirty stove panel protector 220*a* (shown in FIGS. 2A and 2B) can be cleaned to become a clean stove panel protector 220*b*. The clean stove panel protector 220*b* can be returned to the stove panel 110 by aligning the knob cutouts 230 with the control knob receptacles 225 on the stove panel 110 and the control knobs 115 can be secured to the stove panel 110. As illustrated in FIG. 2D, the clean stove panel protector 220*b* is secured to the stove panel 110. By allowing the dirty stove panel protector 220*a* to be removed, cleaning the visible area around the stove panel 110 is made relatively easier as compared to having to wipe, spray, and/or scrub around difficult to reach areas of the stove panel 110 and knobs on a stove without the stove panel protector 220. In addition, the area of the stove panel 110 under the stove panel protector 220 is protected from physical damage by the stove panel protector 220.

Figure 3A:
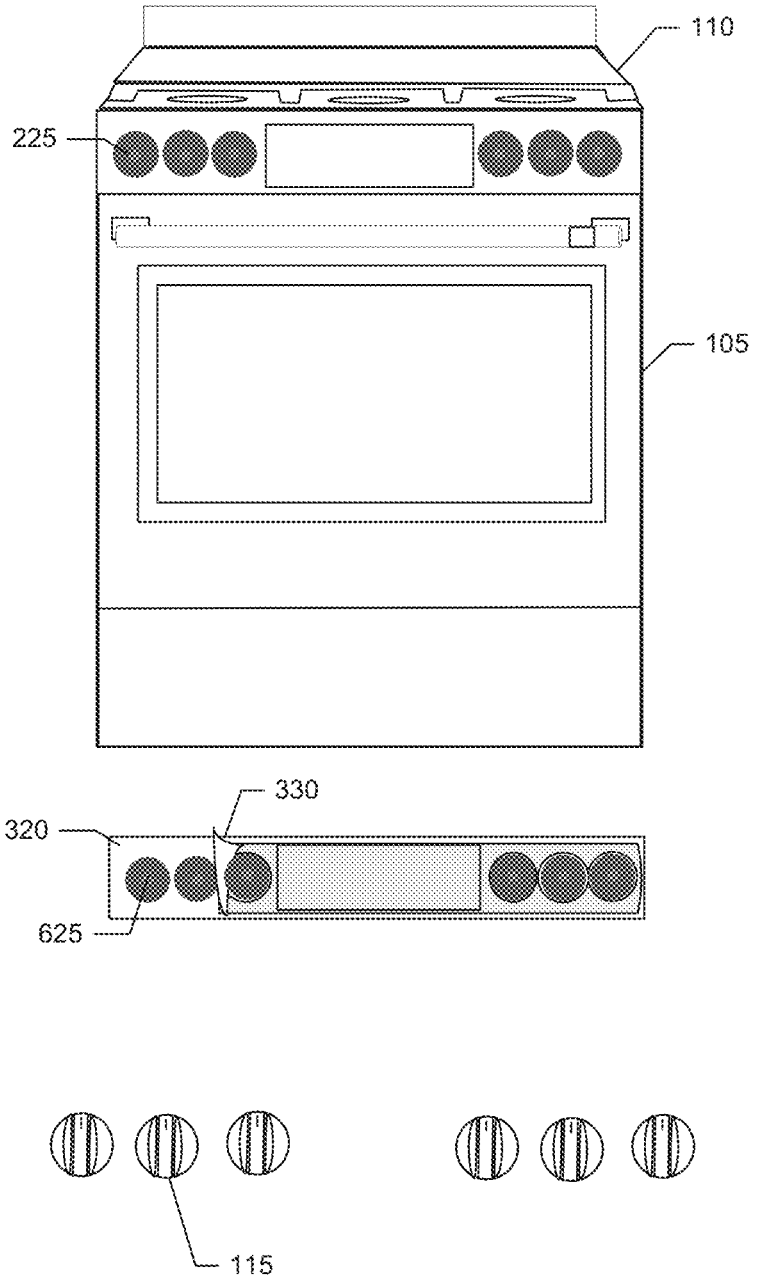
FIG. 3A illustrates a stove panel protector being prepared to be placed on a stove using a peelable adhesive, according to some embodiments of the present disclosure.
Figure 3B:
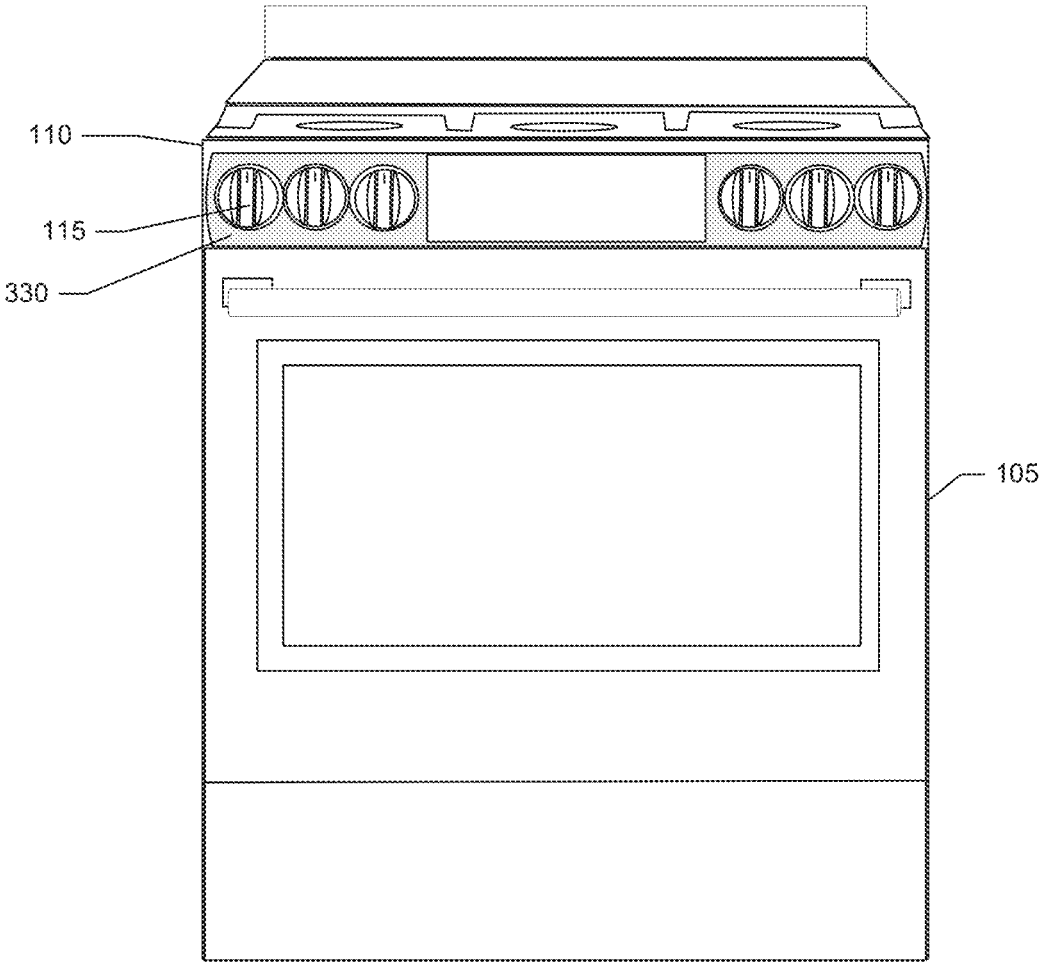
FIG. 3B illustrates the stove panel protector on the stove, according to some embodiments of the present disclosure.

Referring now to FIGS. 3A and 3B, a stove panel protector 320, according to some embodiments of the present disclosure, is illustrated. Before the stove panel protector 320 is coupled to the stove 105, the stove panel protector 320 can include knob cutouts 325 and a peelable backing 330. The knob cutouts 325 align with the control knob receptacles 225 on the stove panel 110 of the stove 105. When the peelable backing 330 is removed from the stove panel protector 320, adhesive on the stove panel protector is exposed to allow the stove panel protector 320 to be secured to the stove panel 110. For example, as illustrated in FIG. 3A, the peelable backing 330 can be removed from the stove panel protector 320. As illustrated in FIG. 3B, the stove panel protector 320 can be removably secured to the stove panel 110 and the burner control knobs 115 can be attached over the stove panel protector 320 to allow the user to control the burners of the stove.

Figure 4A:
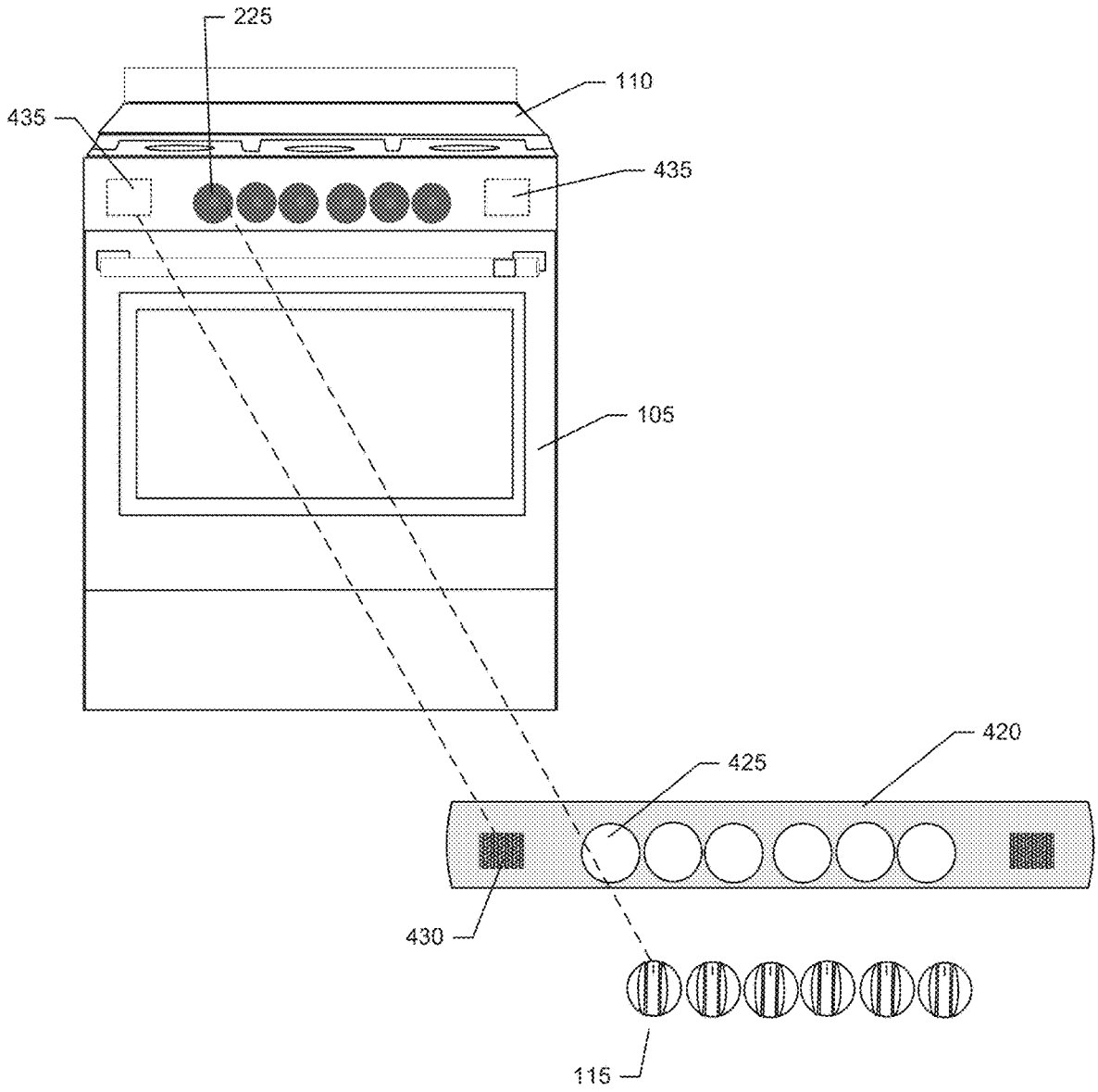
FIG. 4A illustrates a stove panel protector being prepared to be placed on a stove using attachment means, according to some embodiments of the present disclosure.
Figure 4B:
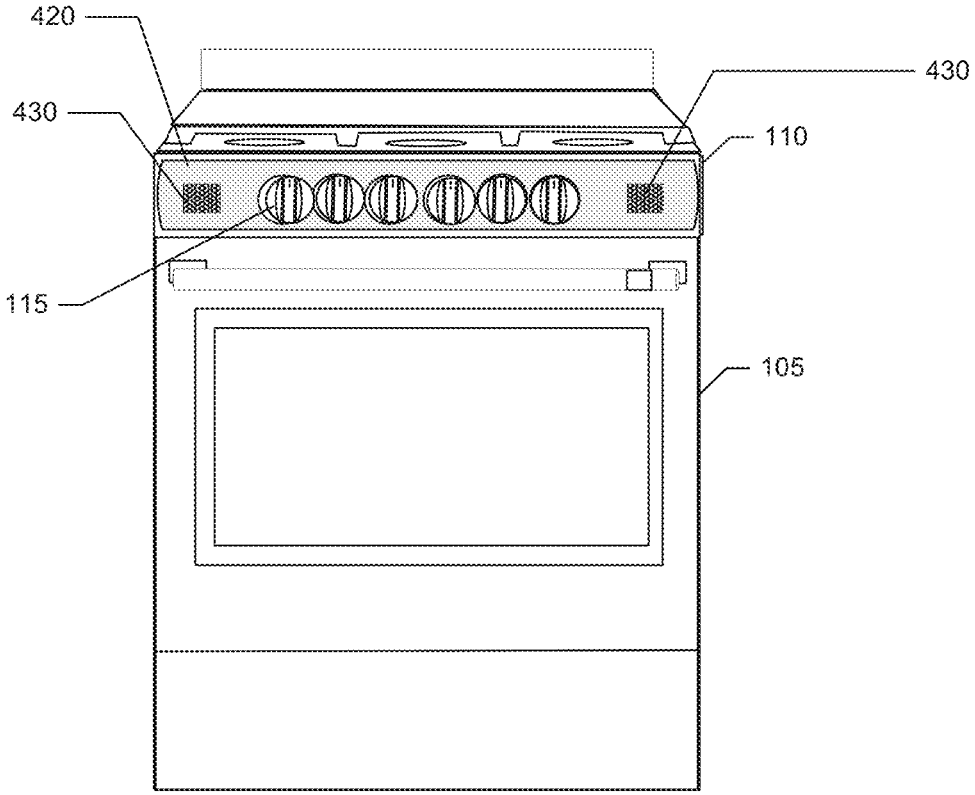
FIG. 4B illustrates the stove panel protector on the stove, according to some embodiments of the present disclosure.

Referring now to FIGS. 4A and 4B, a stove panel protector 420, according to some embodiments of the present disclosure, is illustrated. As illustrated in FIG. 4A, the stove panel protector 420 can include knob cutouts 425 and a stove panel attachment means 430. The knob cutouts 425 align with the control knob receptacles 225 on the stove panel 110 of the stove 105. The stove panel attachment means 430 are configured to couple with stove panel protector attachment means 435 on the stove panel 110. The stove panel attachment means 430 and the stove panel protector attachment means 435 may be adhesive, hook and loop fastener, clips, magnets, or some other attachments means that allows the stove panel attachment means 430 to removably couple with the stove panel protector attachment means 435 and removably secure the stove panel protector 420 to the stove panel 110. As illustrated in FIG. 4B, by coupling the stove panel attachment means 430 to the stove panel protector attachment means 435, the stove panel protector 420 can be removably secured to the stove panel 110. The burner control knobs 115 can be attached over the stove panel protector 420 to allow the user to control the burners of the stove.

Figure 5A:
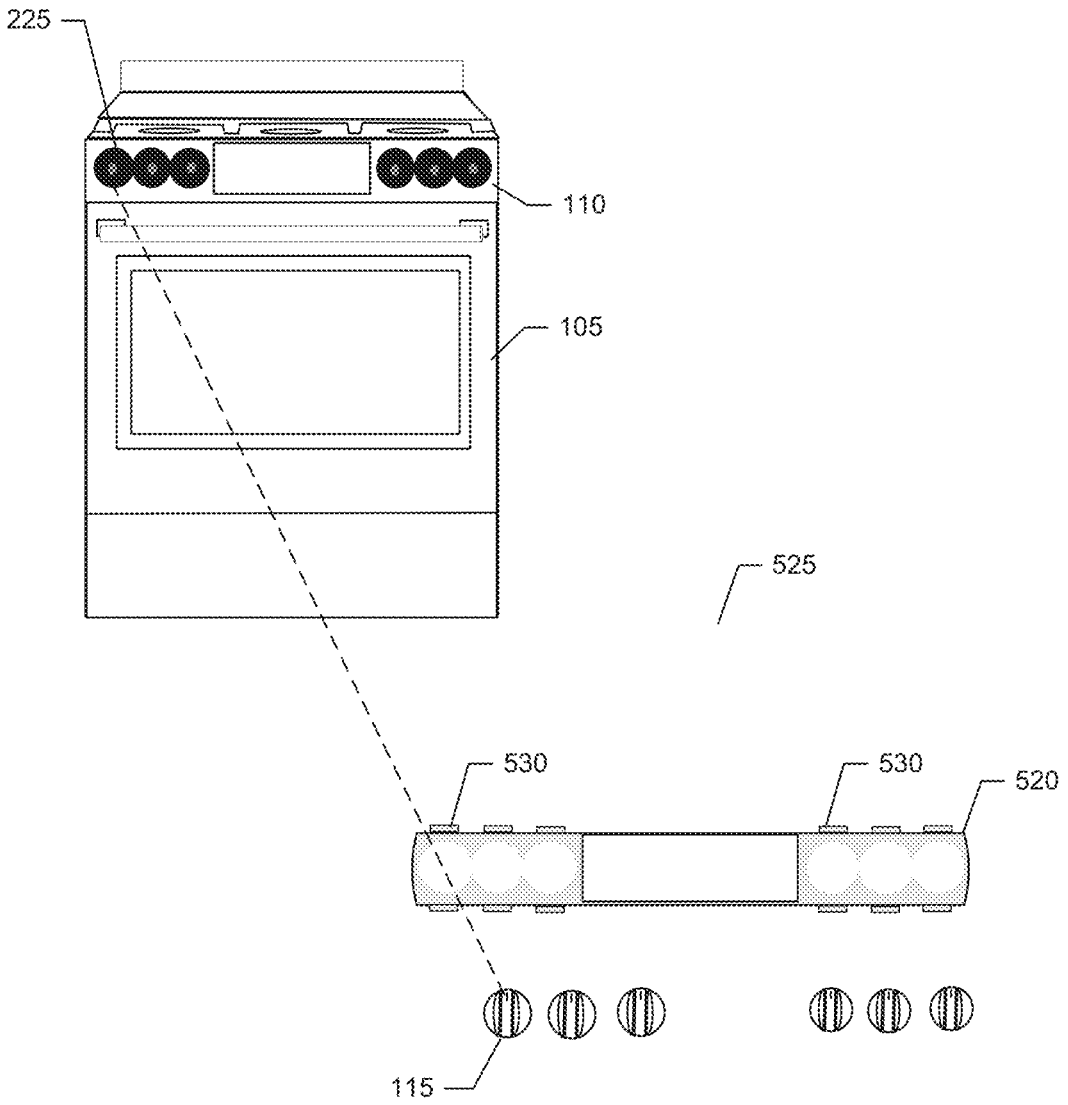
FIG. 5A illustrates a stove panel protector being prepared to be placed on a stove using clips, according to some embodiments of the present disclosure.
Figure 5B:
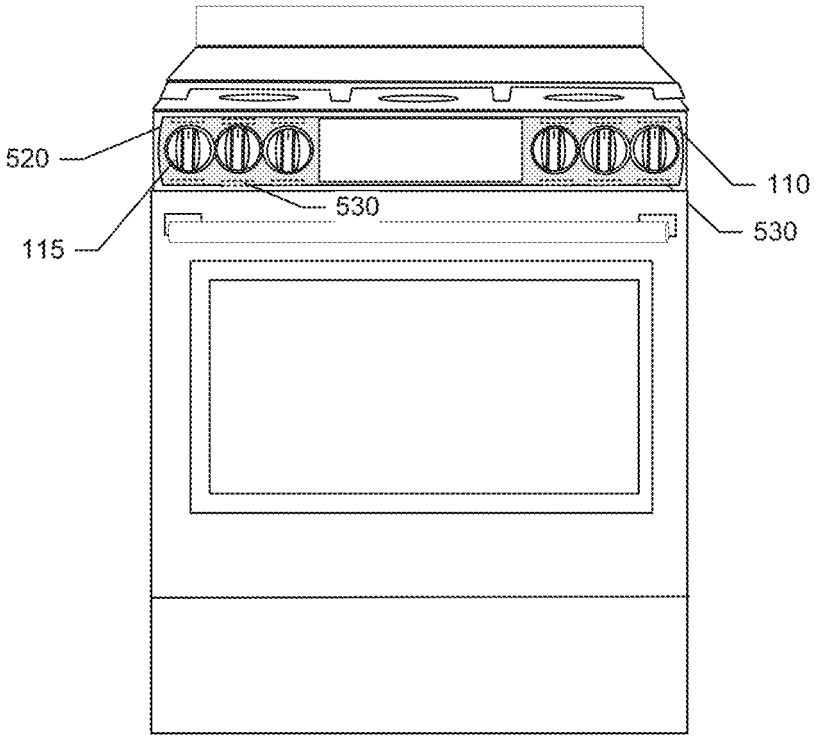
FIG. 5B illustrates the stove panel protector on the stove, according to some embodiments of the present disclosure.

Referring now to FIGS. 5A and 5B, a stove panel protector 520, according to some embodiments of the present disclosure, is illustrated. As illustrated in FIG. 5A, the stove panel protector 520 can include knob cutouts 525 and a stove panel attachment clips 530. The knob cutouts 525 align with the control knob receptacles 225 on the stove panel 110 of the stove 105. The stove panel attachment clips 530 are configured to couple with the stove panel 110. More specifically, the stove panel attachment clips 530 can couple with an edge or groove along at least a portion of the outside edge of the stove panel 110 to removably secure the stove panel protector 520 to the stove panel 110. As illustrated in FIG. 5B, by coupling the stove panel attachment clips 530 to the stove panel 110, the stove panel protector 520 can be removably secured to the stove panel 110. The burner control knobs 115 can be attached over the stove panel protector 520 to allow the user to control the burners of the stove.

Figure 6A:
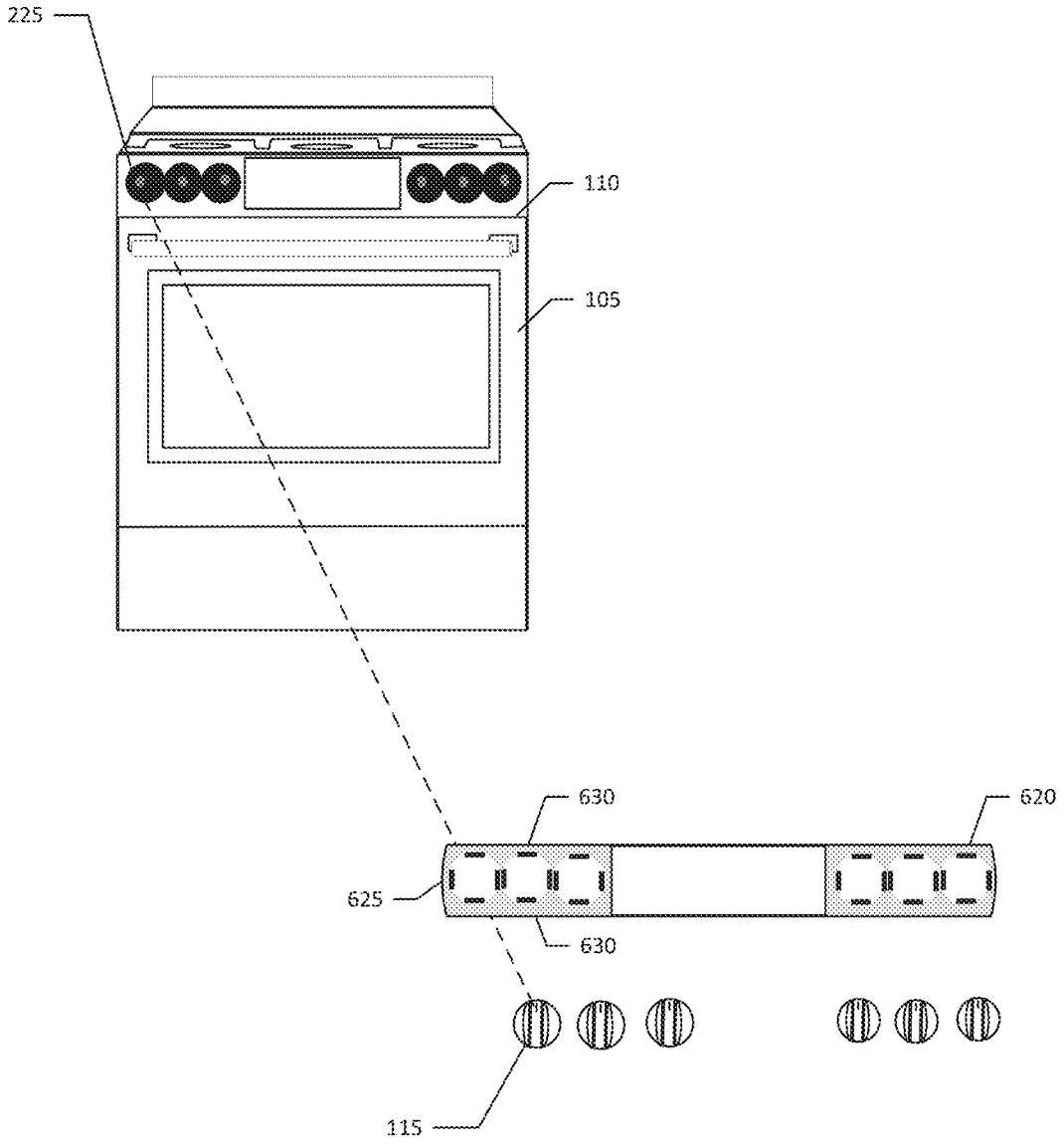
FIG. 6A illustrates a stove panel protector being prepared to be placed on a stove using clips, according to some embodiments of the present disclosure.
Figure 6B:
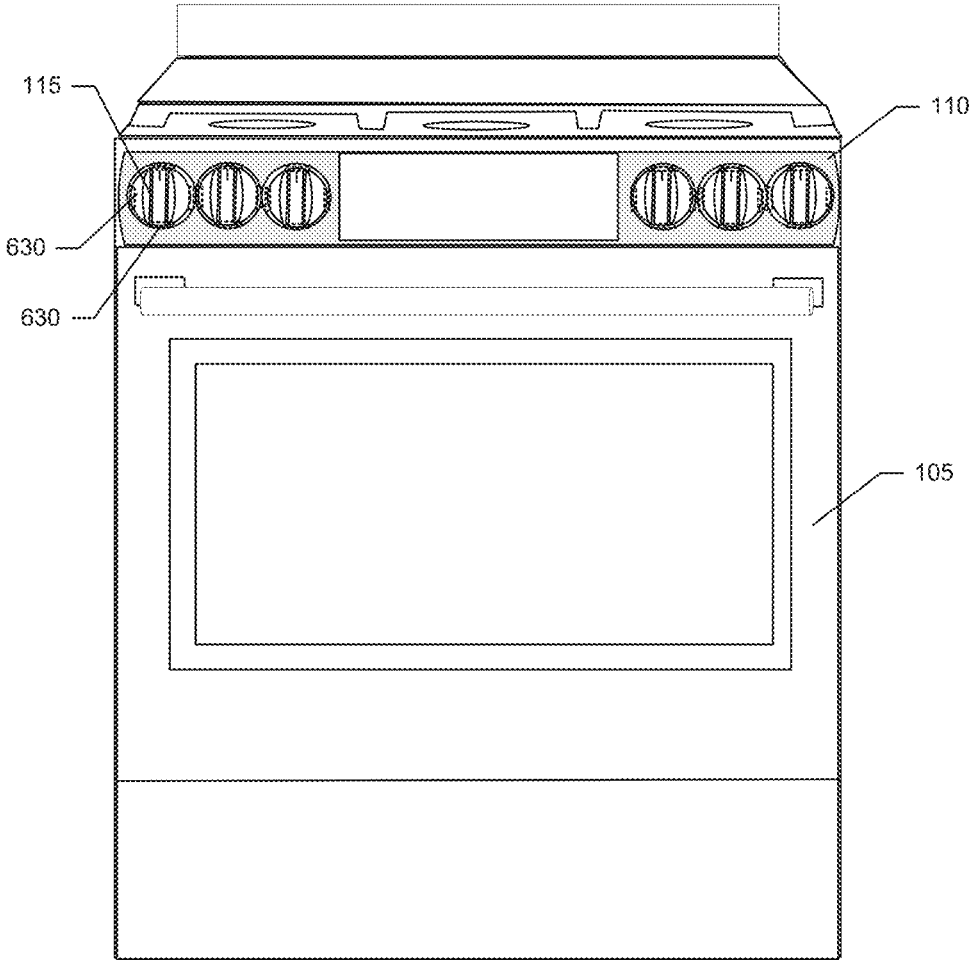
FIG. 6B illustrates the stove panel protector on the stove, according to some embodiments of the present disclosure.

Referring now to FIGS. 6A and 6B, a stove panel protector 620, according to some embodiments of the present disclosure, is illustrated. As illustrated in FIG. 6A, the stove panel protector 620 can include knob cutouts 625. The knob cutouts 625 can include control knob receptacle clips 630. The knob cutouts 625 align with the control knob receptacles 225 on the stove panel 110 of the stove 105. The control knob receptacle clips 630 are configured to couple with the control knob receptacles 225 on the stove panel 110. More specifically, the control knob receptacle clips 630 can couple with an edge or groove along at least a portion of the inside edge of the control knob receptacles 225 to removably secure the stove panel protector 620 to the stove panel 110. As illustrated in FIG. 6B, by coupling the control knob receptacle clips 630 to the control knob receptacles 225, the stove panel protector 620 can be removably secured to the stove panel 110. The burner control knobs 115 can be attached over the stove panel protector 620 to allow the user to control the burners of the stove.

Figure 7A:
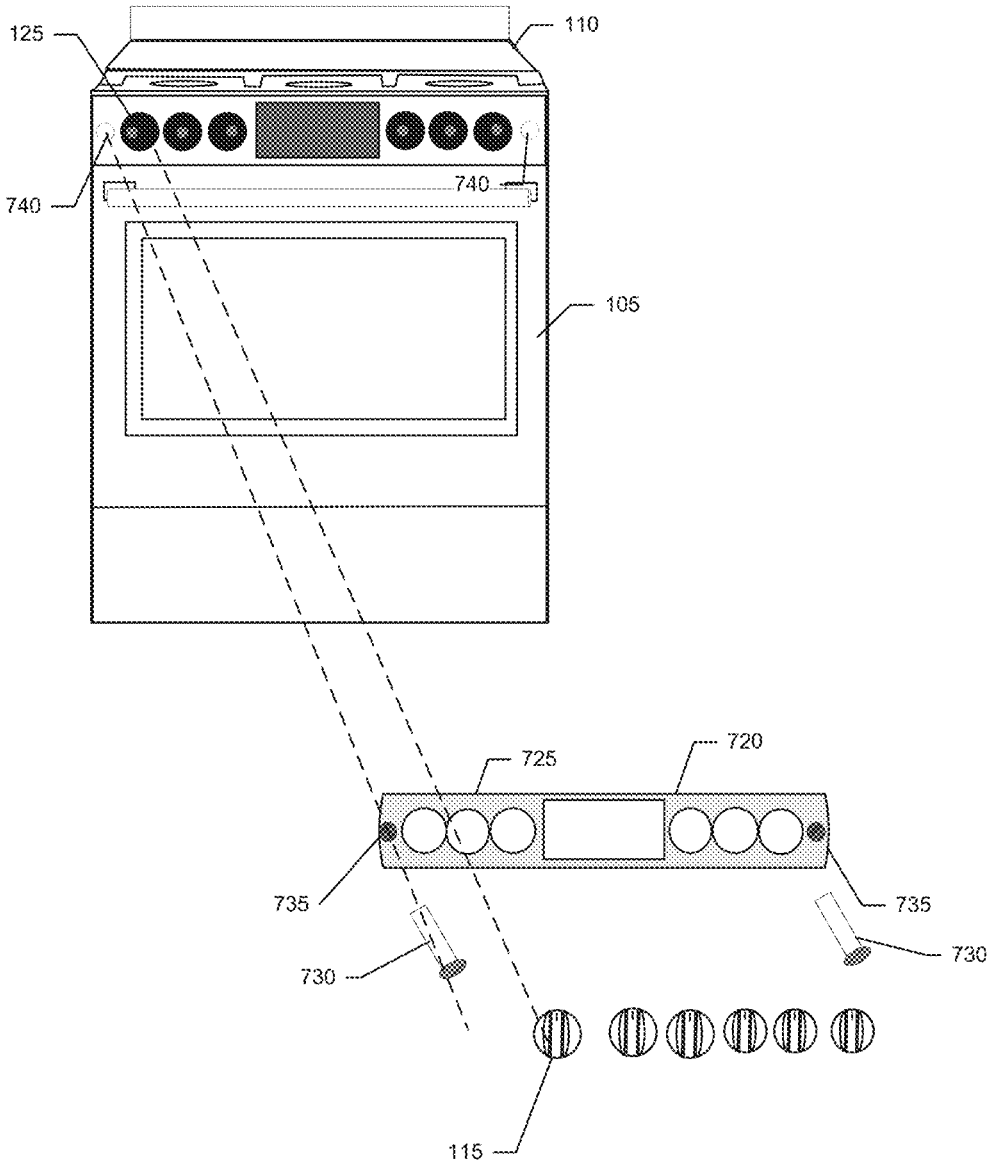
FIG. 7A illustrates a stove panel protector being prepared to be placed on a stove using a fastener, according to some embodiments of the present disclosure.
Figure 7B:
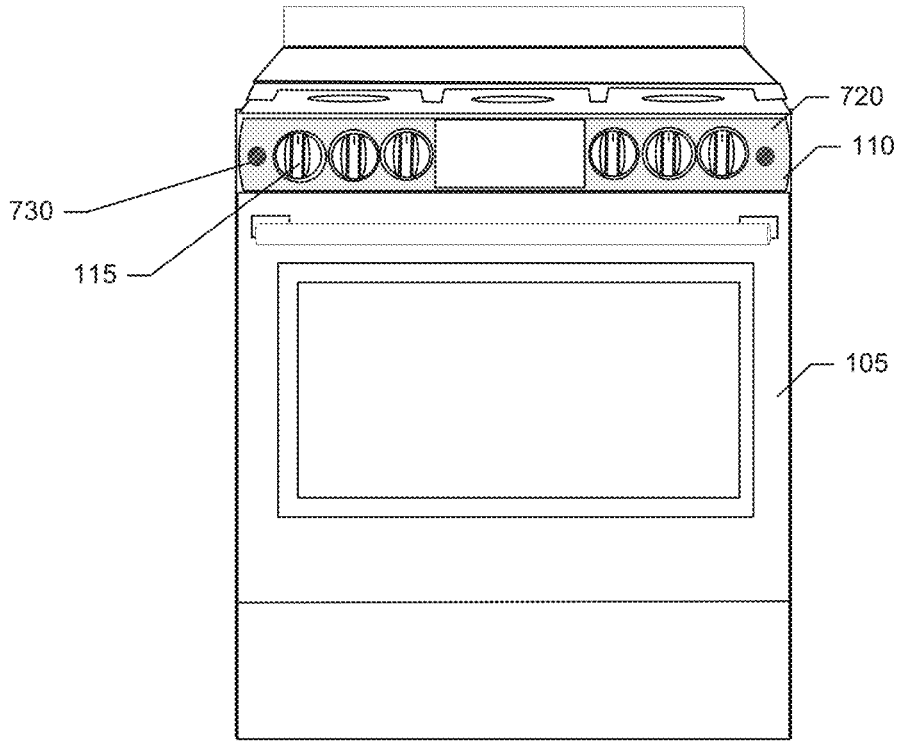
FIG. 7B illustrates the stove panel protector on the stove, according to some embodiments of the present disclosure.

Referring now to FIGS. 7A and 7B, a stove panel protector 720, according to some embodiments of the present disclosure, is illustrated. As illustrated in FIG. 7A, the stove panel protector 720 can include knob cutouts 725 and fastening cutouts 735. The knob cutouts 7625 align with the control knob receptacles 225 on the stove panel 110 of the stove 105. The fastening cutouts 735 align with fastening housings 740 on the stove panel 110. For example, a fastener 730 can pass through the fastening cutout 735 and extend into the fastening housing 740. The fastener 730 can include a fastener head portion 745 that is larger than the fastening cutout 735 to removably secure the stove panel protector 720 to the stove panel 110. More specifically, in a non-limiting example, if the fastener 730 is a screw, the screw can pass through the fastening cutout 735 and be threaded into the fastening housing 740 to removably secure the stove panel protector 720 to the stove panel 110. As illustrated in FIG. 7B, by passing the fastener 730 through the fastening cutout 725 and coupling the fastener 730 to the fastening housing 740, the stove panel protector 720 can be removably secured to the stove panel 110. The burner control knobs 115 can be attached over the stove panel protector 720 to allow the user to control the burners of the stove.

Figure 8:
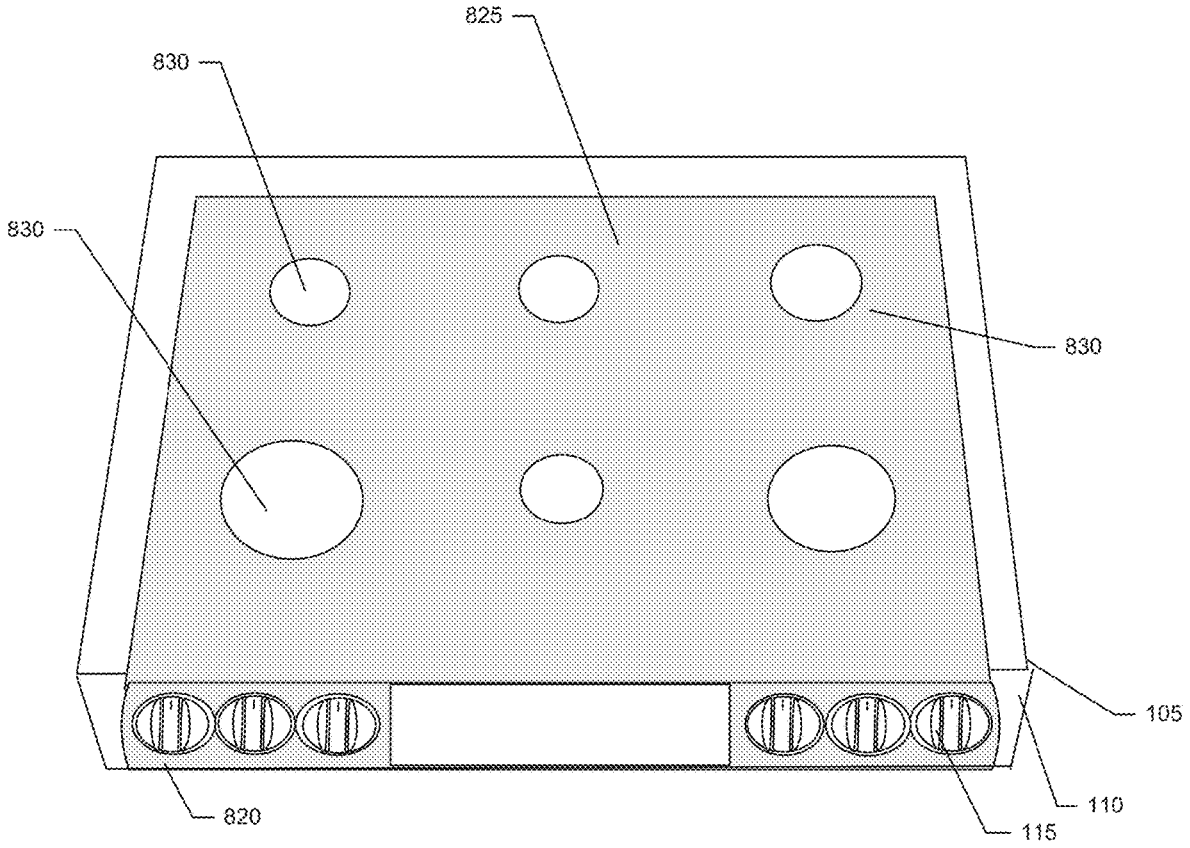
FIG. 8 illustrates a stove panel protector on a stove, according to some embodiments of the present disclosure.

Referring now to FIG. 8, a stove panel protector 820, according to some embodiments of the present disclosure, is illustrated. As illustrated in FIG. 8, the stove panel protector 820 can be attached to a stove burner protector 825. The stove burner protector 825 helps to protect the burners of the stove 105. The stove panel protector 820 is under the burner control knobs 115 of the stove 105 and helps to protect the control panel 110 of the stove 105. In some examples, burner control knobs 115 can be removed to allow the stove panel protector 820 can fold onto the stove burner protector 825 or otherwise be removed from the area of the control panel 110 for cleaning.

Figure 9A:
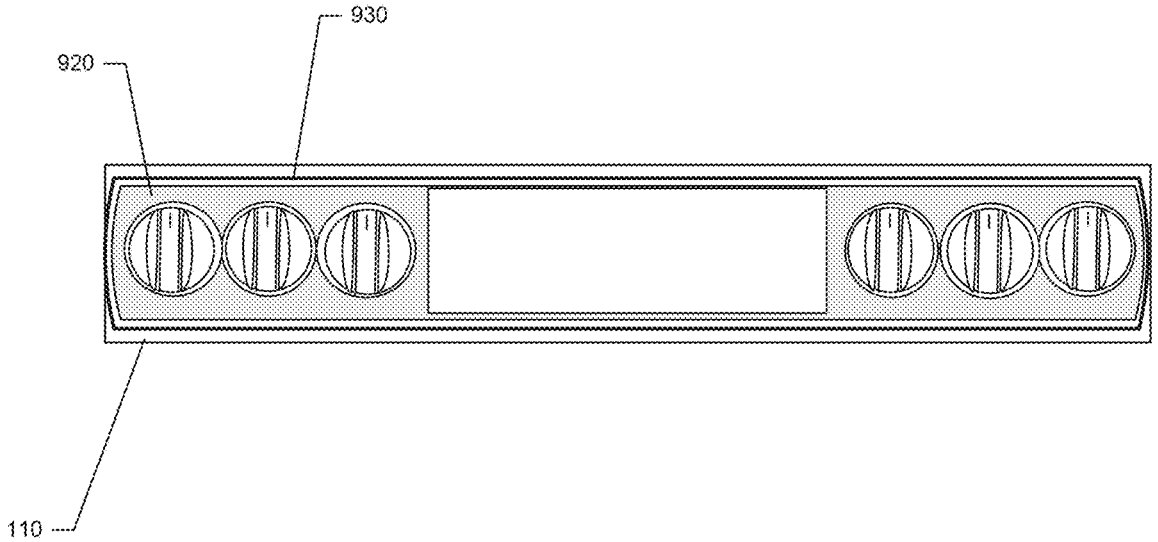
FIGS. 9A and 9B illustrate a stove panel protector on a stove, according to some embodiments of the present disclosure.
Figure 9B:
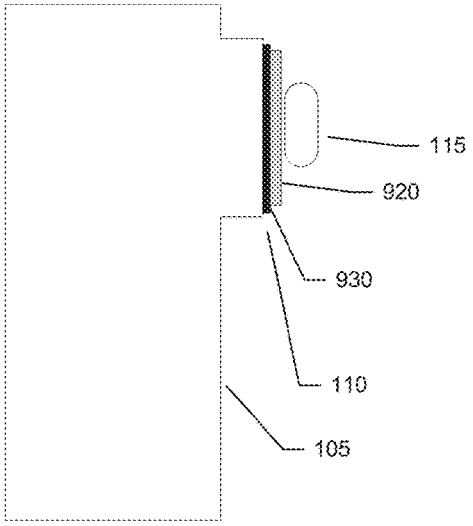

Referring now to FIGS. 9A and 9B, a stove panel protector 920, according to some embodiments of the present disclosure, is illustrated. As illustrated in FIG. 9A, the stove panel protector 920 can include a ridge 930. The ridge 930 can be located on a stove facing side of the stove panel protector 920 and extend at least partially around an outside portion of the stove panel protector 920. As shown in FIG. 9B, when the stove panel protector 920 is attached to the stove panel 110, the ridge 930 on the stove facing side of the stove panel protector 920 helps to create a seal between the stove panel 110 and the stove panel protector 920 and helps prevent liquids and other material (e.g., crumbs) from coming into contact with the area of the stove panel 110 that is covered by the stove panel protector 920.

Figure 10A:
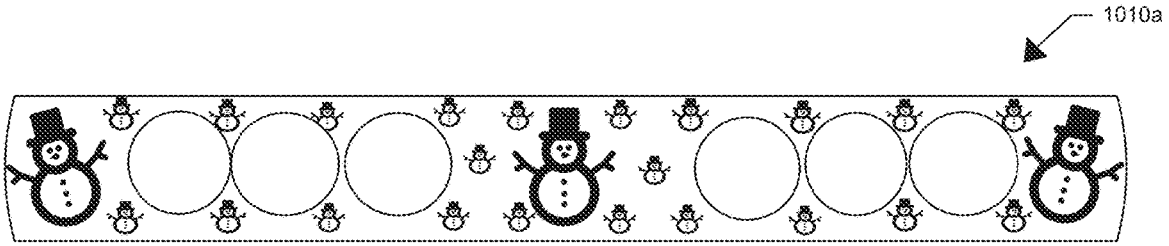
FIGS. 10A-10F illustrate various themed stove panel protectors, according to some embodiments of the present disclosure.
Figure 10B:
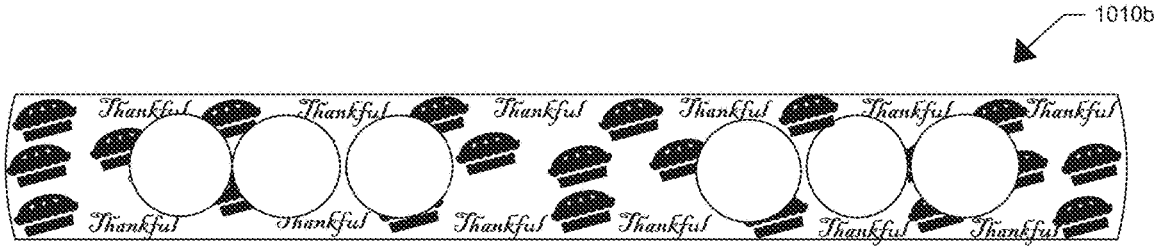
Figure 10C:
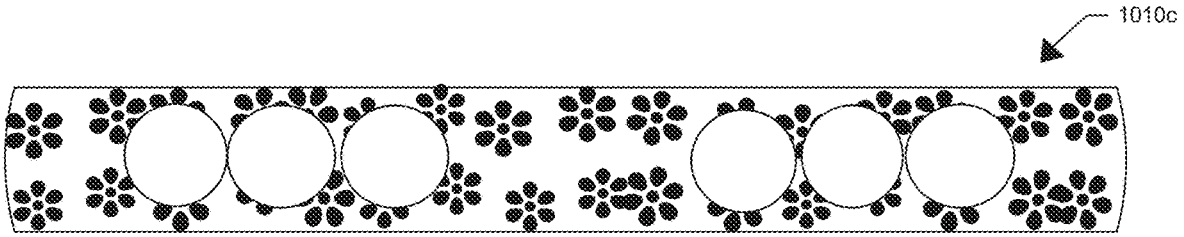
Figure 10D:
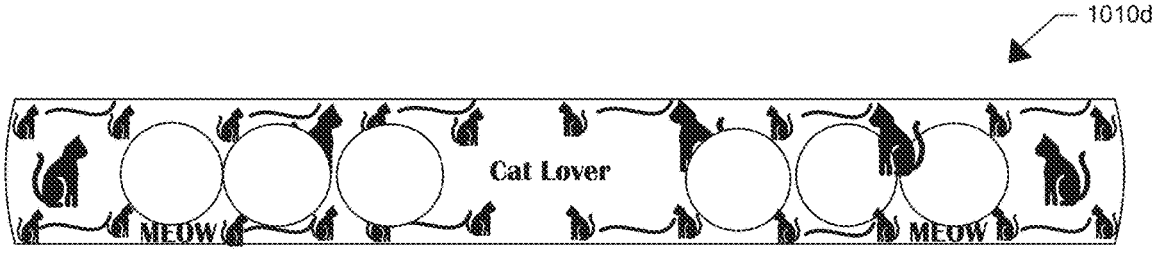
Figure 10E:
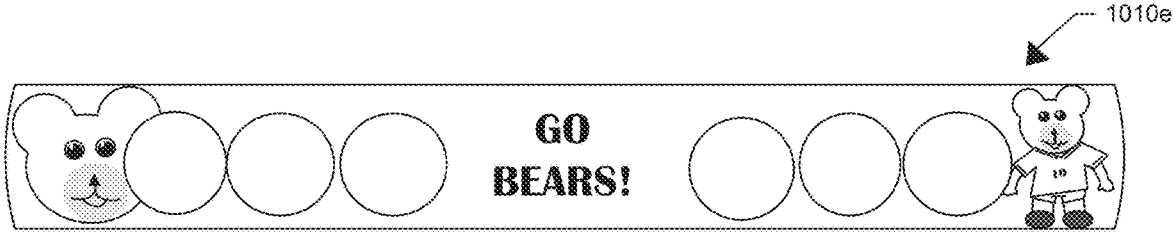
Figure 10F:
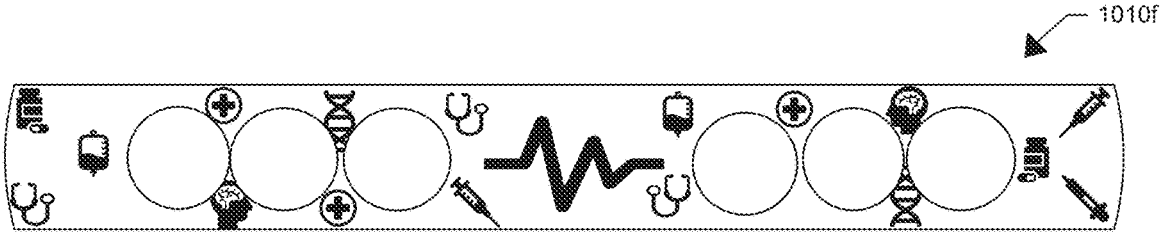

Referring now to FIGS. 10A-10F, a stove panel protector 1020, according to some embodiments of the present disclosure, is illustrated. The stove panel protector 1020 can have a similar form and function as the stove panel protector 120 shown in FIG. 1. In addition, the stove panel protector 1020 can have an aesthetic quality. More specifically, as shown in FIG. 10*a*, a stove protection 1020*a* can include a winter or Christmas theme. As shown in FIG. 10*b*, a stove panel protector 1020*b* can have a Thanksgiving theme. As shown in FIG. 10*c*, a stove panel protector 1020*c* can have a spring or Easter theme. As shown in FIG. 10*d*, a stove panel protector 1020*d* can have a cat or some other animal or object theme. As shown in FIG. 10*e*, a stove panel protector 1020*e* can have a school or university theme. As shown in FIG. 10*f*, a stove panel protector 1020*f* can have a specific company or profession theme. Note that the themes shown in FIGS. 10A-10F are only examples, and other themes may be used.

Figure 11:
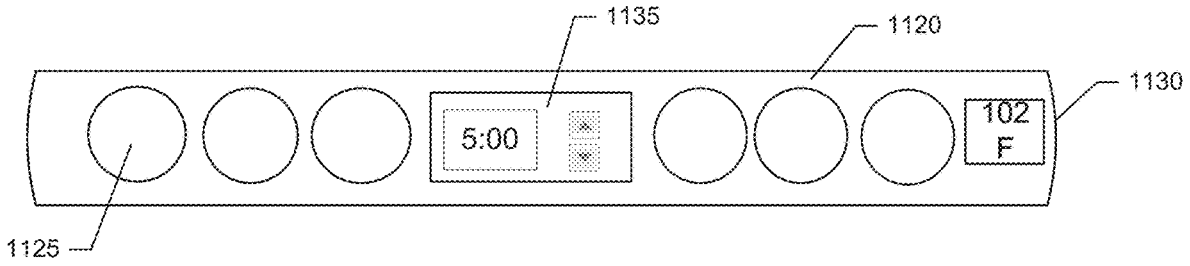
FIG. 11 illustrates a stove panel protector, according to some embodiments of the present disclosure.

Referring now to FIG. 11, a stove panel protector 1120, according to some embodiments of the present disclosure, is illustrated. The stove panel protector 1120 can have a similar form and function as the stove panel protector 120 shown in FIG. 1. The stove panel protector 1120 can include control knob receptacles 1125, a temperature readout 1130, and a timer 1135. The control knob receptacles 1125 align with knob cutouts (e.g., the knob cutouts 230 shown in FIG. 2) on a stove panel (e.g., the stove panel 110 shown in FIG. 2). The temperature readout 1130 can be a digital temperature readout that displays the temperature of one or more burners on a stove and/or the temperature of the stove panel 110. The timer 1135 can be a digital timer that a user can set similar to a digital kitchen timer.

Figure 12:
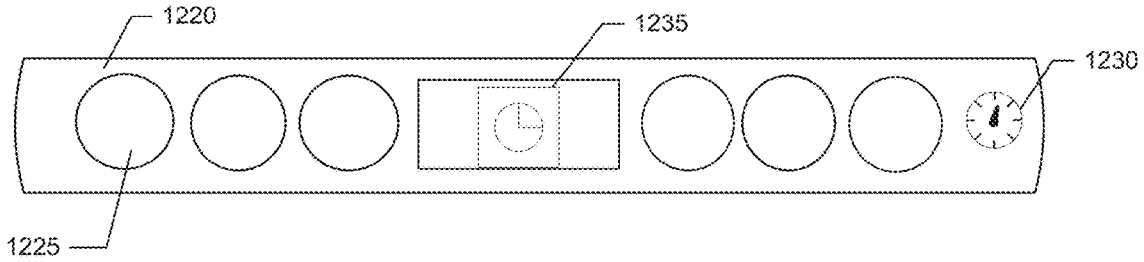
FIG. 12 illustrates a stove panel protector, according to some embodiments of the present disclosure.

Referring now to FIG. 12, a stove panel protector 1220, according to some embodiments of the present disclosure, is illustrated. The stove panel protector 1220 can have a similar form and function as the stove panel protector 120 shown in FIG. 1. The stove panel protector 1220 can include control knob receptacles 1225, a temperature readout 1230, and a timer 1235. The control knob receptacles 1225 align with knob cutouts (e.g., the knob cutouts 230 shown in FIG. 2) on a stove panel (e.g., the stove panel 110 shown in FIG. 2). The temperature readout 1230 can be a mechanical thermostat (e.g., a stove thermostat) that displays the temperature of one or more burners on a stove and/or the temperature of the stove panel 110. The timer 1235 can be a mechanical timer that a user can set similar to a mechanical kitchen timer.

Figure 13:
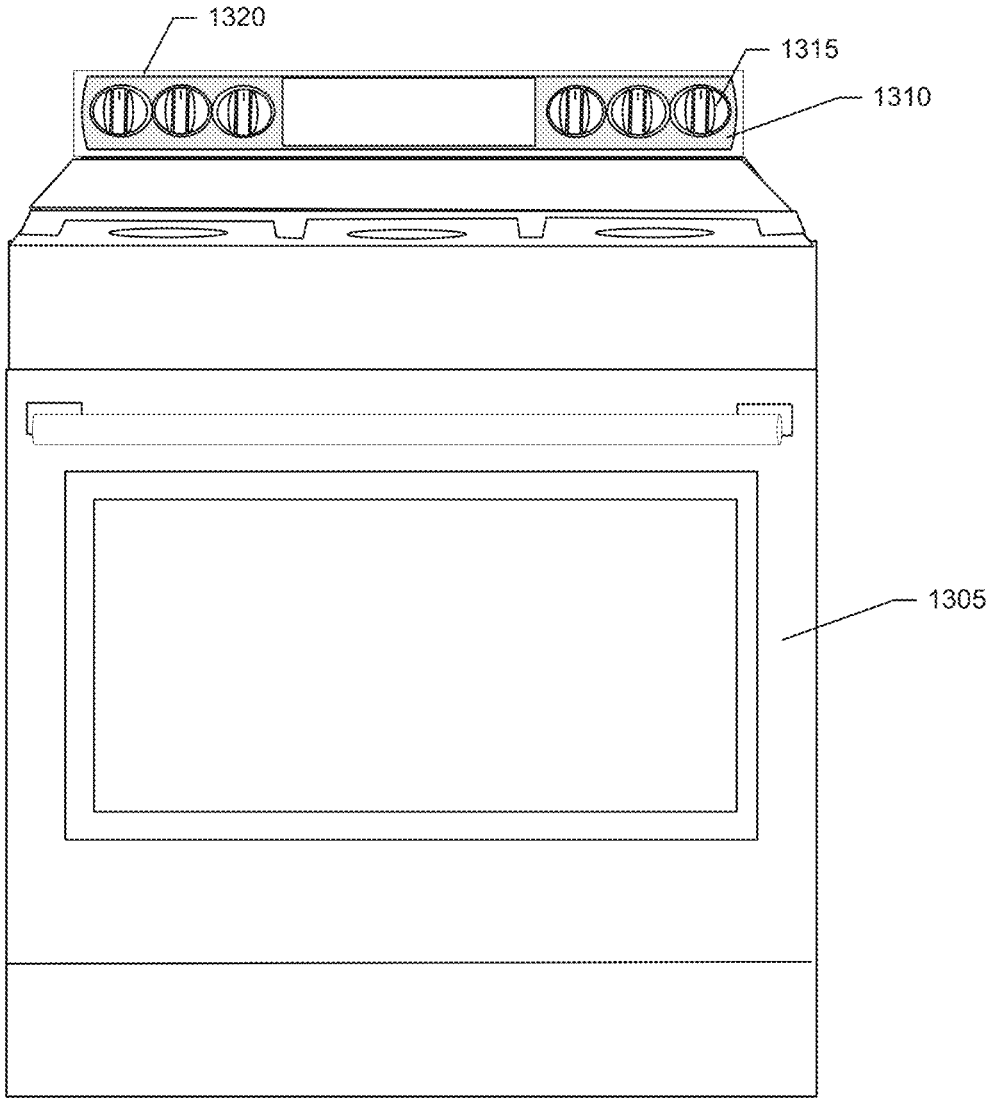
FIG. 13 illustrates a stove panel protector, according to some embodiments of the present disclosure.

Referring now to FIG. 13, a stove panel protector 1320, according to some embodiments of the present disclosure, is illustrated. The stove panel protector 1320 can have a similar form and function as the stove panel protector 120 shown in FIG. 1. As illustrated in FIG. 13, the stove panel protector 1320 is located on a stove panel 1310 of a stove 1305. The stove panel protector 1320 is under burner control knobs 1315 of the stove 1305 and allows a user to access the burner control knobs 1315 to control the burners of the stove. The stove panel protector 1320 helps to protect the stove panel 1310 from physical damage as well as from spills, splashes, spatters, etc.

Figure 14:
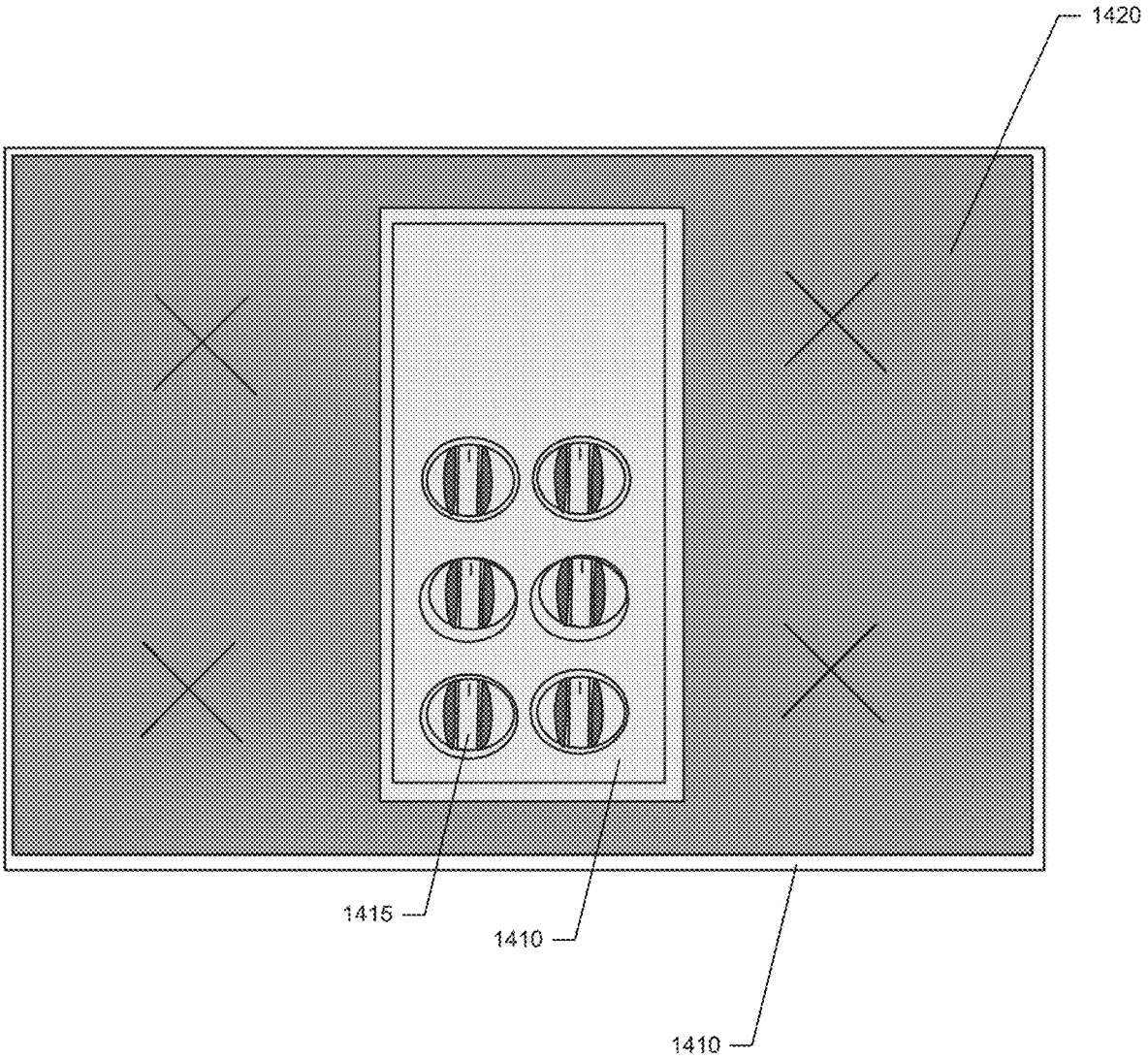
FIG. 14 illustrates a stove panel protector, according to some embodiments of the present disclosure.
Figure 15A:
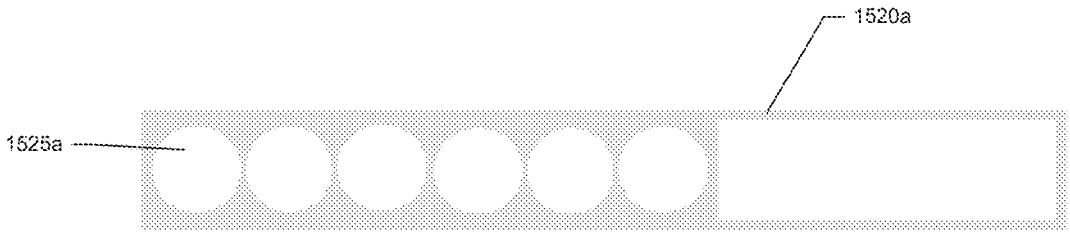
FIGS. 15A-15D illustrate various stove panel protectors with different profiles, according to some embodiments of the present disclosure.
Figure 15B:
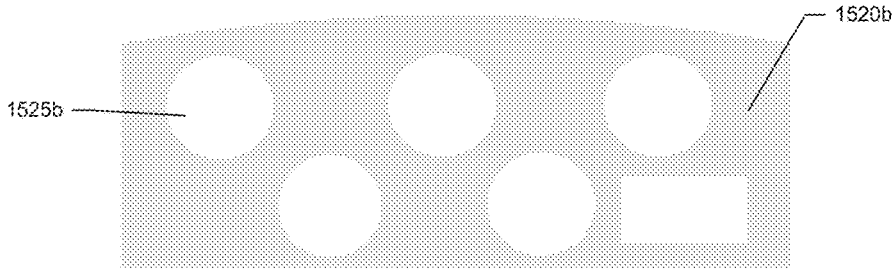
Figure 15C:
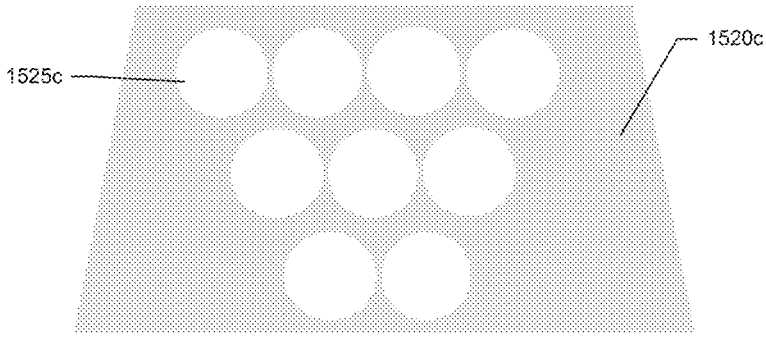
Figure 15D:
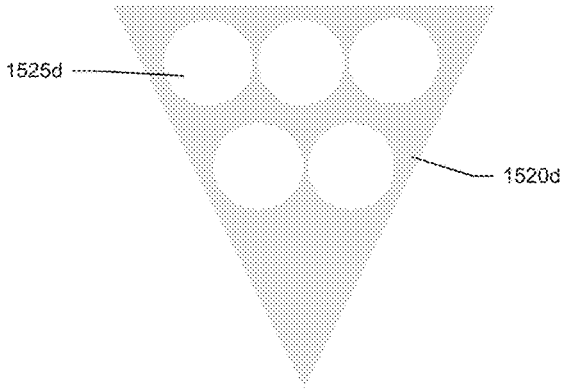

Referring now to FIG. 14, a stove panel protector 1420, according to some embodiments of the present disclosure, is illustrated. The stove panel protector 1420 can have a similar form and function as the stove panel protector 120 shown in FIG. 1. As illustrated in FIG. 14, the stove panel protector 1420 is located on a stove panel 1410 of a stove 1405. The stove panel protector 1420 is under burner control knobs 1415 of the stove 1405 and allows a user to access the burner control knobs 1415 to control the burners of the stove. The stove panel protector 1420 helps to protect the stove panel 1410 from physical damage as well as from spills, splashes, spatters, etc.

Referring now to FIGS. 15A-15D, a stove panel protector 1520, according to some embodiments of the present disclosure, is illustrated. The stove panel protector 1520 can have a similar form and function as the stove panel protector 120 shown in FIG. 1. Note that the stove panel protectors shown in FIGS. 15A-15D are only examples, and other configurations and profiles may be used, depending on design constraints and configuration of the stove panel of a stove. For example, a stove panel protector 1520*a* shown in FIG. 15A can be configured to be used on a stove with a stove panel that has a relatively long rectangular profile and six burner control knobs. A stove panel protector 1520*b* shown in FIG. 15B can be configured to be used on a stove with a stove panel that has a rounded rectangular profile and five burner control knobs. A stove panel protector 1520*c* shown in FIG. 15C can be configured to be used on a stove with a stove panel that has a trapezoidal profile and nine burner control knobs. A stove panel protector 1520*d* shown in FIG. 15*d* can be configured to be used on a stove with a stove panel that has a triangular profile and five burner control knobs.

Figure 16:
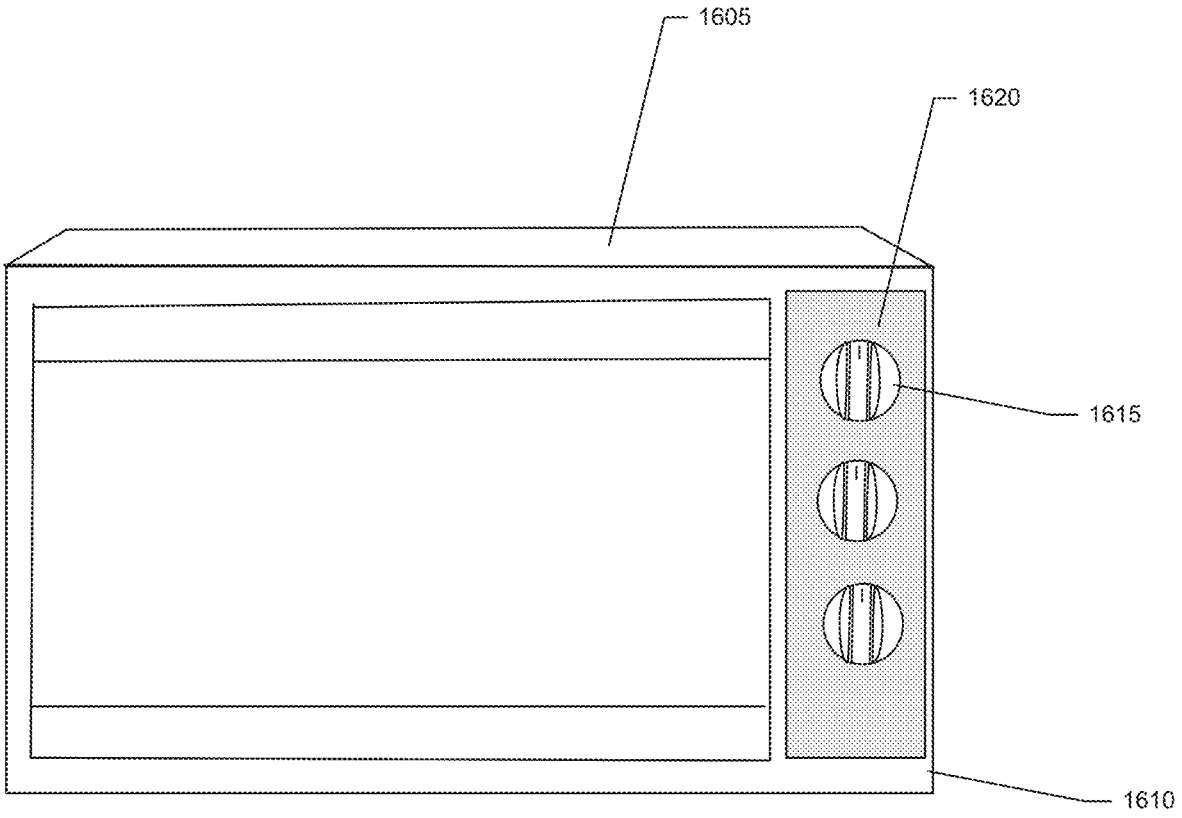
FIG. 16 illustrates an appliance panel protector on an appliance, according to some embodiments of the present disclosure.

Referring now to FIG. 16, an appliance panel protector 1620, according to some embodiments of the present disclosure, is illustrated. The appliance panel protector 1620 can have a similar form and function as the stove panel protector 120 shown in FIG. 1. As illustrated in FIG. 16, the appliance panel protector 1620 is located on a control panel 1610 of an appliance 1605 (e.g., a countertop oven). The appliance panel protector 1620 helps to protect the control panel 1610 from physical damage as well as from spills, splashes, spatters, etc.

Figure 17:
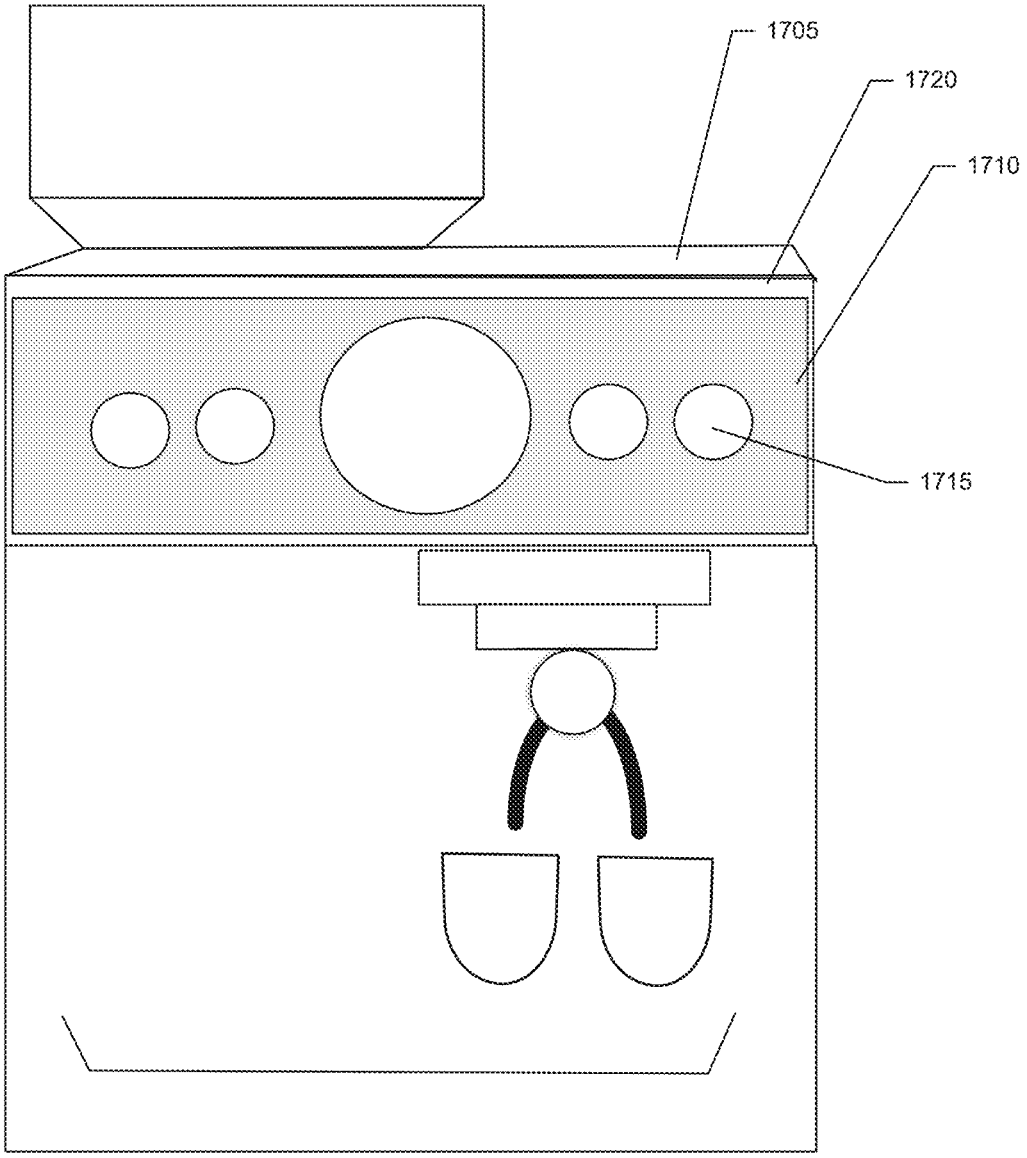
FIG. 17 illustrates an appliance panel protector on an appliance, according to some embodiments of the present disclosure.

Referring now to FIG. 17, an appliance panel protector 1720, according to some embodiments of the present disclosure, is illustrated. The appliance panel protector 1720 can have a similar form and function as the stove panel protector 120 shown in FIG. 1. As illustrated in FIG. 17, the appliance panel protector 1720 is located on a control panel 1710 of an appliance 1705 (e.g., an espresso maker). The appliance panel protector 1720 helps to protect the control panel 1710 from physical damage as well as from spills, splashes, spatters, etc.

Figure 18:
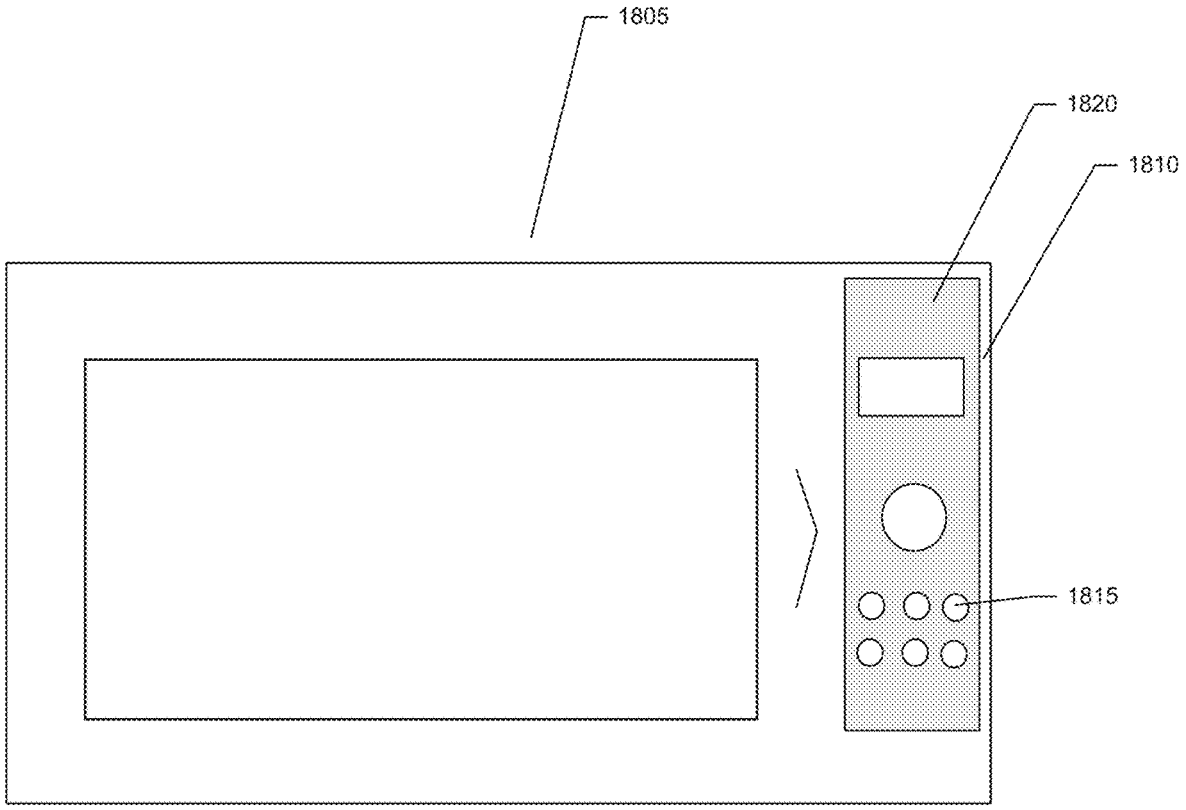
FIG. 18 illustrates an appliance panel protector on an appliance, according to some embodiments of the present disclosure.

Referring now to FIG. 18, an appliance panel protector 1820, according to some embodiments of the present disclosure, is illustrated. The appliance panel protector 1820 can have a similar form and function as the stove panel protector 120 shown in FIG. 1. As illustrated in FIG. 18, the appliance panel protector 1820 is located on a control panel 1810 of an appliance 1805 (e.g., a microwave). The appliance panel protector 1820 helps to protect the control panel 1810 from physical damage as well as from spills, splashes, spatters, etc.

Figure 19:
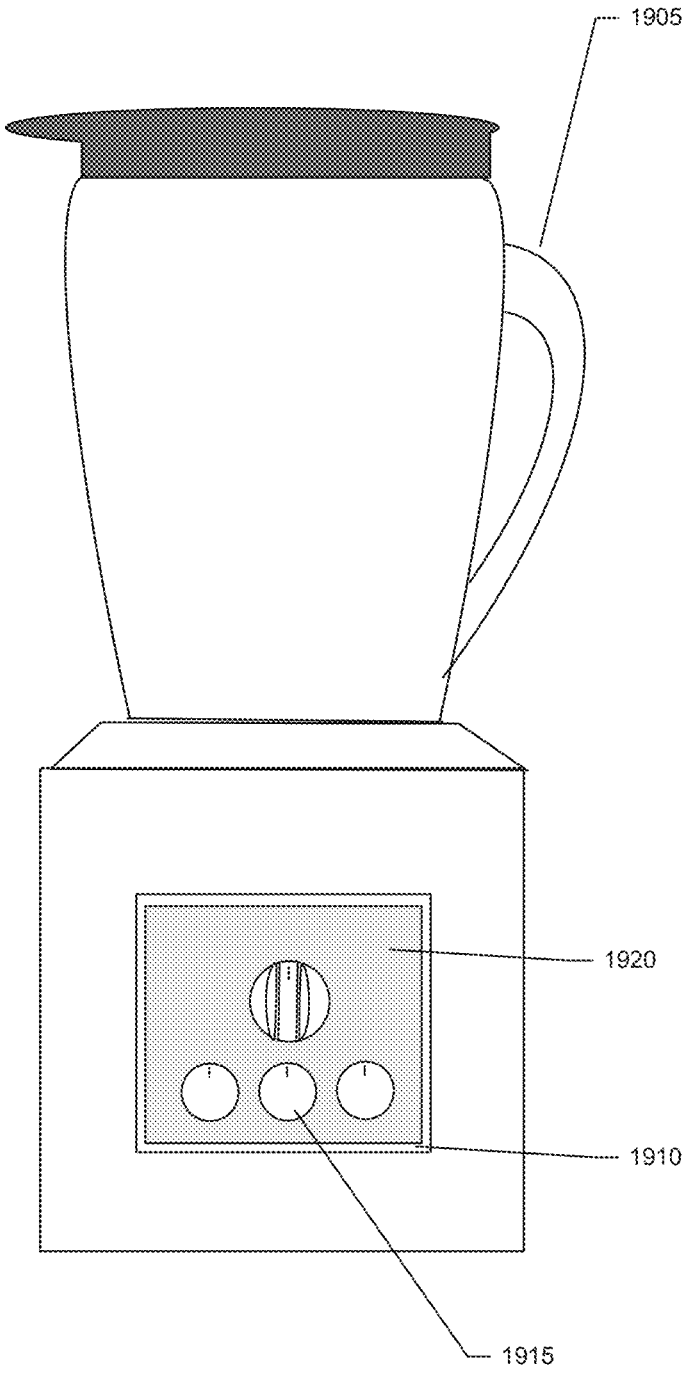
FIG. 19 illustrates an appliance panel protector on an appliance, according to some embodiments of the present disclosure.

Referring now to FIG. 19, an appliance panel protector 1920, according to some embodiments of the present disclosure, is illustrated. The appliance panel protector 1920 can have a similar form and function as the stove panel protector 120 shown in FIG. 1. As illustrated in FIG. 19, the appliance panel protector 1920 is located on a control panel 1910 of an appliance 1905 (e.g., a blender). The appliance panel protector 1920 helps to protect the control panel 1910 from physical damage as well as from spills, splashes, spatters, etc.

Figure 20:
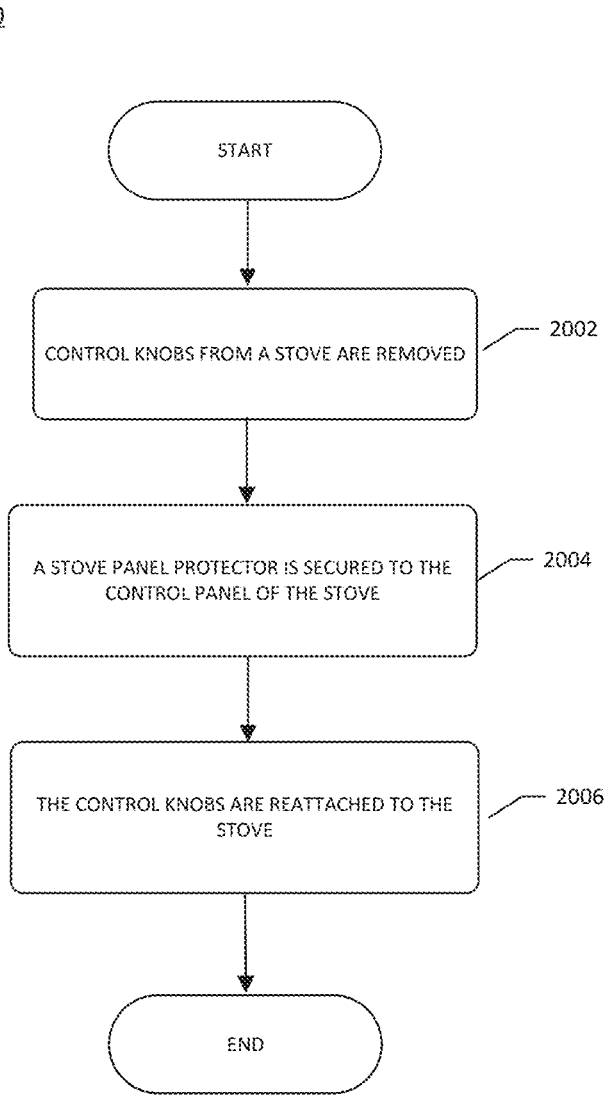
FIG. 20 illustrates a simplified flowchart illustrating potential operations that may be associated with a stove panel protector in accordance with an embodiment of the present disclosure.

Referring now to FIG. 20, an example flowchart illustrating possible operations of a flow 2000 that may be associated with stove panel protector, according to some embodiment of the present disclosure is illustrated. At 2002, control knobs from a stove are removed. At 2004, a stove panel protector is removably secured to a control panel of the stove. At 2006, the control knobs are reattached to the stove.

Figure 21:
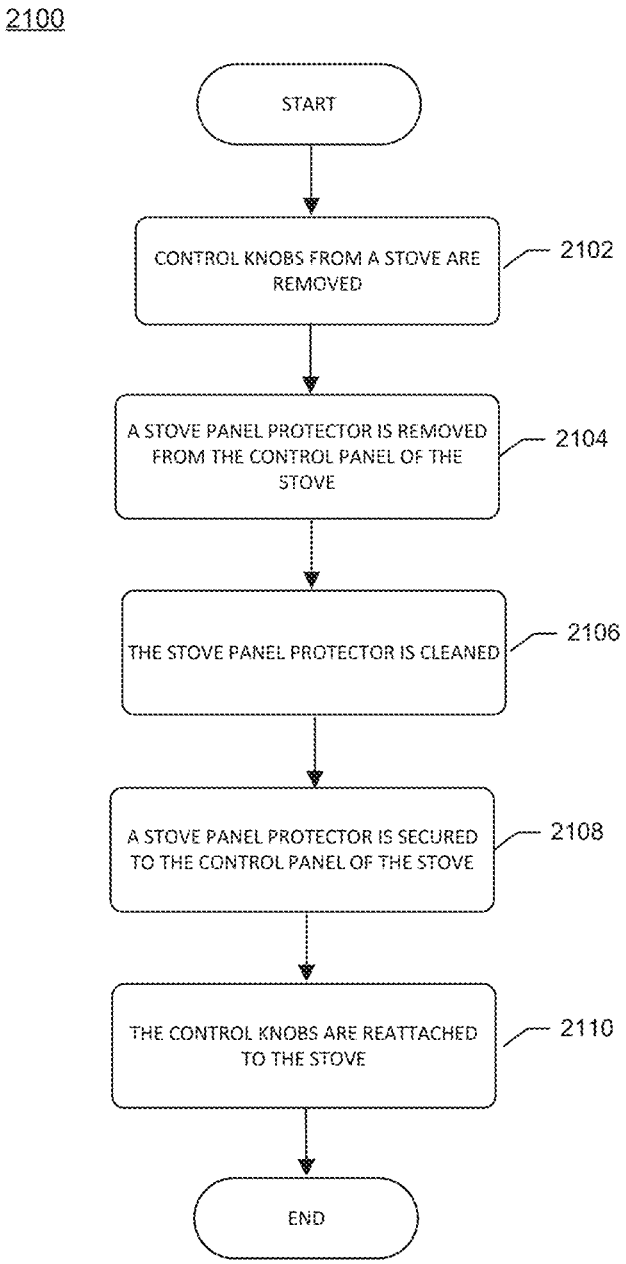
FIG. 21 illustrates a simplified flowchart illustrating potential operations that may be associated with a stove panel protector in accordance with an embodiment of the present disclosure.

Referring now to FIG. 21, an example flowchart illustrating possible operations of a flow 2100 that may be associated with stove panel protector, according to some embodiment of the present disclosure is illustrated. At 2102, control knobs from a stove are removed. At 2014, a stove panel protector is removed from the control panel of the stove. At 2106, the stove panel protector is cleaned. At 2108, the stove panel protector is secured to the control panel of the stove. At 2110, the control knobs are attached to the stove.

Figure 22:
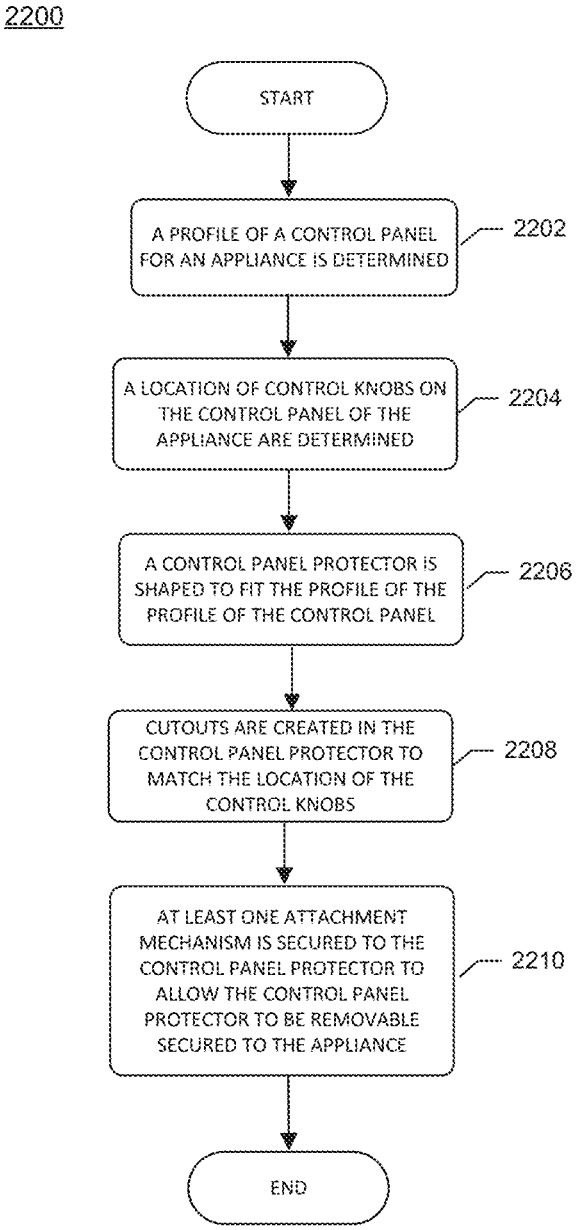
FIG. 22 illustrates a simplified flowchart illustrating potential operations that may be associated with a stove panel protector in accordance with embodiment of the present disclosure.

Referring now to FIG. 22, an example flowchart illustrating possible operations to a flow 2200 that may be associated with an appliance panel protector, according to some embodiment of the present disclosure is illustrated. At 2202, a profile of a control panel for an appliance is determined. At 2204, a location of control knobs on the control panel of the appliance are determined. At 2206, a control panel protector is shaped to fit the profile of the profile of the control panel. At 2208, cutouts are created in the control panel protector to match the location of the control knobs. At 2210, at least one attachment mechanism is secured to the control panel protector to allow the control panel protector to be removed secured to the appliance.

Conclusion

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A stove panel protector to help protect the control panel of a stove, the stove panel protector consisting of:

a profile that matches the control panel of the stove, wherein the profile of the control panel is determined using the model number of the appliance;

cutouts to match the location of control knobs on the control panel; and one or more securing mechanisms to removably secure the control panel protector to the control panel of the stove under the control knobs, wherein the one or more securing mechanisms comprises adhesive with a peelable backing, and wherein when the control panel protector is applied, the control knobs are accessible to control one or more burners of the stove, wherein the control panel protector is configured to be removed, cleaned, and re-secured;

an aesthetic quality on a surface of the stove panel protector including at least a first theme.

2. The stove panel protector of claim 1, wherein the control panel protector is removably secured to the control panel using a mechanical fastener.

3. The stove panel protector of claim 1, wherein the control panel protector is heat resistant.

4. The stove panel protector of claim 1, wherein the stove panel protector is made of tempered glass, polycarbonate, vinyl, or acrylic.

5. A method for securing a stove panel protector to a control panel of a stove, the method consisting of:

removing control knobs from the stove;

removably securing the stove panel protector to the control panel of the appliance, wherein the stove panel protector has a profile that matches the control panel of the stove and includes cutouts that match the location of the control knobs on the control panel, and wherein the profile of the control panel is determined using the model number of the appliance;

removing the control panel protector from the control panel:

cleaning the control panel protector;

re-securing the control panel protector to the control panel; and reattaching the control knobs to the stove, wherein the control knobs are accessible to control one or more burners of the stove.

6. The method of claim 5, wherein the control panel protector is removably secured to the control panel using adhesive.

7. The method of claim 5, wherein the control panel protector is removably secured to the control panel using a mechanical fastener.

8. The method of claim 5, wherein the control panel protector is washable in a dishwasher.

9. A method consisting of:

determining a profile of a control panel for an appliance, wherein the profile of the control panel is determined using the model number of the appliance;

determining the location of control knobs on the control panel;

shaping a control panel protector to fit the profile of the control panel;

creating cutouts in the control panel protector to match the location of the control knobs;

adding at least one attachment mechanism to allow the control panel protector to be removably secured the control panel protector to the control panel of the appliance, wherein the at least one attachment mechanism comprises adhesive with a peelable backing, and wherein when the control panel protector is applied to the control panel, the control knobs are accessible to control one or more burners of the stove;

removing the control panel protector from the control panel;

cleaning the control panel protector; and re-securing the control panel protector to the control panel.

10. The method of claim 9, wherein the appliance is a kitchen stove.

11. The method of claim 9, wherein the attachment mechanism is at least one mechanical fastener.

12. The method of claim 9, further comprising:

removing the control panel protector from the control panel;

cleaning the control panel protector; and re-securing the control panel protector to the control panel.

13. The method of claim 9, wherein the control panel protector is heat resistant.

14. The method of claim 9, wherein the control panel protector is made of tempered glass.

15. The method of claim 9, wherein the control panel protector is clear.

16. The method of claim 9, wherein the control panel protector is made of polycarbonate.

17. The method of claim 9, wherein the control panel protector is made of vinyl.

* * * * *